US008894388B2

(12) United States Patent
Lee et al.

(10) Patent No.: US 8,894,388 B2
(45) Date of Patent: Nov. 25, 2014

(54) COMPRESSOR HAVING FIRST AND SECOND ROTARY MEMBER ARRANGEMENT USING A VANE

(75) Inventors: Kangwook Lee, Changwon-si (KR); Jin-Ung Shin, Changwon-si (KR); Yongchol Kwon, Changwon-si (KR); Geun-Hyoung Lee, Busan (KR)

(73) Assignee: LG Electronics Inc., Seoul (KR)

( * ) Notice: Subject to any disclaimer, the term of this patent is extended or adjusted under 35 U.S.C. 154(b) by 520 days.

(21) Appl. No.: 13/055,040

(22) PCT Filed: Nov. 28, 2008

(86) PCT No.: PCT/KR2008/007014

§ 371 (c)(1),
(2), (4) Date: Jan. 20, 2011

(87) PCT Pub. No.: WO2010/010997

PCT Pub. Date: Jan. 28, 2010

(65) Prior Publication Data

US 2011/0126579 A1 Jun. 2, 2011

(30) Foreign Application Priority Data

Jul. 22, 2008 (KR) ..... 10-2008-0071381
Nov. 13, 2008 (KR) ..... 10-2008-0112743
Nov. 13, 2008 (KR) ..... 10-2008-0112759

(51) Int. Cl.

| | |
|---|---|
| ***F04B 35/04*** | (2006.01) |
| ***F04C 18/332*** | (2006.01) |
| ***F04C 18/324*** | (2006.01) |
| ***F04C 29/12*** | (2006.01) |
| ***F04C 18/32*** | (2006.01) |
| ***F04C 23/00*** | (2006.01) |
| *F04C 29/00* | (2006.01) |

(52) U.S. Cl.

CPC ..... *F04C 23/008* (2013.01); *F04C 2240/603* (2013.01); *F04C 18/32* (2013.01); *F04C 29/0085* (2013.01)

USPC ..... 417/356; 418/64; 418/66

(58) Field of Classification Search

USPC ..... 417/356; 418/13, 63, 64, 66, 67

See application file for complete search history.

(56) References Cited

U.S. PATENT DOCUMENTS 1,526,449 A 2/1925 Wishart
1,947,016 A 2/1934 Mallory (Continued)

FOREIGN PATENT DOCUMENTS

CN 1963224 5/2007
EP 1 798 372 A1 6/2007

(Continued)

OTHER PUBLICATIONS

European Search Report dated Feb. 1, 2012 issued in Application No. 08 87 6616.

(Continued)

*Primary Examiner* — Nathan Zollinger
(74) *Attorney, Agent, or Firm* — Ked & Associates, LLP

(57) ABSTRACT

A rotary compressor is provided that includes an electric motor that supplies electric power and a compression mechanism that compresses a refrigerant while first and second rotary members rotate upon receipt of the electric power from the electric motor. More particularly, the compressor has a compact design by forming a compression space within the compressor by a rotor of the electric motor that drives the compressor, maximizes compression efficiency by minimizing friction loss between rotating elements within the compressor, and has a structure that minimizes leakage of the refrigerant within the compression space.

22 Claims, 15 Drawing Sheets

(56) References Cited

U.S. PATENT DOCUMENTS

| | | | | |
|---|---|---|---|---|
| 1,998,604 | A | 4/1935 | Belden | |
| 2,246,273 | A | 6/1941 | Ward | |
| 2,246,275 | A * | 6/1941 | Davidson | 417/356 |
| 2,246,276 | A | 6/1941 | Ward | |
| 2,309,577 | A | 1/1943 | Ward | |
| 2,324,434 | A | 7/1943 | Shore | |
| 2,331,878 | A | 10/1943 | Wentworth | |
| 2,420,124 | A | 5/1947 | Coulson | 230/139 |
| 2,440,593 | A | 4/1948 | Miller | |
| 2,898,032 | A | 8/1959 | Bernhard | |
| 3,070,078 | A | 12/1962 | Horst | |
| 3,499,600 | A | 3/1970 | McGregor | |
| 3,723,024 | A | 3/1973 | Sawai et al. | |
| 4,478,559 | A | 10/1984 | Andrione et al. | |
| 4,629,403 | A | 12/1986 | Wood | |
| 4,710,111 | A | 12/1987 | Kubo | |
| 4,844,703 | A | 7/1989 | Watanabe et al. | |
| 5,522,235 | A | 6/1996 | Matsuoka et al. | |
| 5,547,344 | A | 8/1996 | Sugiyama et al. | |
| 5,564,916 | A | 10/1996 | Yamamoto et al. | |
| 5,577,903 | A | 11/1996 | Yamamoto | |
| 5,580,231 | A | 12/1996 | Yasui | |
| 5,616,019 | A | 4/1997 | Hattori et al. | |
| 6,077,058 | A | 6/2000 | Saitou et al. | |
| 6,213,732 | B1 | 4/2001 | Fujio | |
| 6,478,558 | B2 | 11/2002 | Yamanaka et al. | |
| 6,484,846 | B1 | 11/2002 | Parker | |
| 6,491,063 | B1 | 12/2002 | Benatav | |
| 6,749,405 | B2 | 6/2004 | Bassine | |
| 6,881,041 | B2 | 4/2005 | Lee | |
| 6,929,455 | B2 | 8/2005 | Dreiman et al. | |
| 7,029,252 | B2 | 4/2006 | Masuda et al. | |
| 7,104,764 | B2 | 9/2006 | Lee et al. | |
| 7,217,110 | B2 * | 5/2007 | Dreiman | 418/173 |
| 7,293,966 | B2 | 11/2007 | Cho et al. | |
| 7,344,367 | B2 | 3/2008 | Manole | |
| 7,361,004 | B2 | 4/2008 | Hwang et al. | |
| 7,556,485 | B2 | 7/2009 | Kanayama et al. | |
| 7,704,060 | B2 | 4/2010 | Morimoto et al. | |
| 2004/0071570 | A1 | 4/2004 | Dreiman et al. | |
| 2005/0008519 | A1 | 1/2005 | Masuda et al. | |
| 2005/0031465 | A1 * | 2/2005 | Dreiman et al. | 417/356 |
| 2005/0201884 | A1 | 9/2005 | Dreiman | 418/173 |
| 2006/0159570 | A1 | 7/2006 | Manole | |
| 2012/0171065 | A1 | 7/2012 | Lee | |

FOREIGN PATENT DOCUMENTS

| | | | |
|---|---|---|---|
| FR | 345995 | A | 12/1904 |
| FR | 1367234 | A | 7/1964 |
| GB | 478146 | | 1/1938 |
| JP | 57-186086 | A | 11/1982 |
| JP | 60-187783 | A | 9/1985 |
| JP | 60-206995 | A | 10/1985 |
| JP | 61-187591 | A | 8/1986 |
| JP | 01-232191 | A | 9/1989 |
| JP | 2008-069643 | | 3/2008 |
| KR | 20-0252922 | | 11/2001 |
| KR | 10-2004-0003346 | | 1/2004 |
| KR | 10-2007-0073314 | | 7/2007 |
| WO | WO 2008/004983 | | 1/1998 |
| WO | WO 2007/074637 | | 7/2007 |

OTHER PUBLICATIONS

European Search Report dated Feb. 1, 2012 issued in Application No. 08 87 6617.

European Search Report dated Feb. 1, 2012 issued in Application No. 08 87 6619.

International Search Report issued in PCT Application No. PCT/KR2008/007014 dated Feb. 10, 2010.

International Search Report issued in PCT Application No. PCT/KR2008/007006 dated Feb. 10, 2010.

International Search Report issued in PCT Application No. PCT/KR2008/007007 dated Feb. 16, 2010.

International Search Report issued in PCT Application No. PCT/KR2008/007008 dated Feb. 16, 2010.

International Search Report issued in PCT Application No. PCT/KR2008/007015 dated Feb. 10, 2010.

International Search Report issued in PCT Application No. PCT/KR2008/007016 dated Feb. 16, 2010.

Chinese Office Action dated Dec. 4, 2012.

U.S. Office Action issued in U.S. Appl. No. 13/054,981 dated Mar. 26, 2013.

U.S. Office Action issued in U.S. Appl. No. 13/055,026 dated Mar. 25, 2013.

U.S. Office Action issued in U.S. Appl. No. 13/054,981 dated Nov. 21, 2013.

U.S. Office Action issued in U.S. Appl. No. 13/054,970 dated Jan. 31, 2014.

U.S. Notice of Allowance issued in U.S. Appl. No. 13/055,026 dated Sep. 12, 2013.

U.S. Office Action issued in U.S. Appl. No. 13/055,020 dated Sep. 23, 2013.

U.S. Office Action issued in U.S. Appl. No. 13/054,963 dated Oct. 10, 2013.

Korean Office Action dated Jun. 2, 2014.

U.S. Office Action issued in U.S. Appl. No. 13/054,951 dated Jun. 20, 2014.

Korean Office Action dated Jun. 24, 2014.

U.S. Office Action issued in U.S. Appl. No. 13/055,020 dated Jun. 25, 2014.

U.S. Notice of Allowance issued in U.S. Appl. No. 13/054,963 dated Jun. 30, 2014.

* cited by examiner

COMPRESSOR HAVING FIRST AND SECOND ROTARY MEMBER ARRANGEMENT USING A VANE

TECHNICAL FIELD

The present invention relates to a compressor, and more particularly, to a compressor which enables a compact design by forming a compression space within the compressor by a rotor of an electric motor part driving the compressor, maximizes compression efficiency by minimizing friction loss between rotating elements within the compressor, and has a structure capable of minimizing leakage of refrigerant within the compression space.

BACKGROUND ART

In general, a compressor is a mechanical apparatus for compressing the air, refrigerant or other various operation gases and raising a pressure thereof, by receiving power from a power generation apparatus sixth as an electric motor or turbine. The compressor has been widely used for an electric home appliance such as a refrigerator and an air conditioner, or in the whole industry.

The compressors are roughly classified into a reciprocating compressor in which a compression space for sucking or discharging an operation gas is formed between a piston and a cylinder, and the piston is linearly reciprocated inside the cylinder, for compressing a refrigerant, a rotary compressor in which a compression space for sucking or discharging an operation gas is formed between an eccentrically-rotated roller and a cylinder, and the roller is eccentrically rotated along the inner wall of the cylinder, for compressing a refrigerant, and a scroll compressor in which a compression space for sucking or discharging an operation gas is formed between an orbiting scroll and a fixed scroll, and the orbiting scroll is rotated along the fixed scroll, for compressing a refrigerant.

While the reciprocating compressor has superior mechanical efficiency, such a reciprocating motion causes serious vibration and noise problems. Due to these problems, rotary compressors have been developed because of compact size and excellent vibration characteristics. A rotary compressor is constructed such that an electric motor and a compression mechanism part are mounted on a driving shaft. A roller located around an eccentric portion of the driving shaft is located within a cylinder defining a cylindrical compression space, at least one vane extends between the roller and the compression space to partition the compression space into a suction region and a compression region, and the roller is eccentrically located within the compression space. Generally, the vane is constructed to press a surface of the roller by being supported on a recessed portion of the cylinder by a spring. By means of such a vane, the compression space is partitioned into a suction region and a compression region as stated above. As the suction region becomes gradually larger along with the rotation of the driving shaft, a refrigerant or working fluid is sucked into the suction region. At the same time, as the compression region becomes gradually smaller, the refrigerant or working fluid therein is compressed.

In such a conventional rotary compressor, as the eccentric portion of the driving shaft rotates, the roller continuously comes into sliding contact with an inner surface of a stationary cylinder, and the roller continuously comes into contact with a tip surface of a stationary vane. Between the components which are thus in sliding contact, a high relative speed exists, and hence a friction loss occurs. This leads to a degradation of the efficiency of the compressor. Further, there is always the possibility of refrigerant leakage on a contact surface between the vane and the roller which are in sliding contact, thus redwing mechanical reliability.

Unlike the conventional rotary compressor which is targeted for a stationary cylinder, the U.S. Pat. No. 7,344,367 discloses a rotary compressor in which a compression space is located between a rotor and a roller rotatably mounted on a stationary shaft. In this patent, the stationary shaft longitudinally extends into a housing, and includes a motor stator and a rotor. The rotor is rotatably mounted on the stationary shaft within the housing, and the roller is rotatably mounted on an eccentric portion which is integrally formed on the stationary shaft. Since a vane is engaged between the rotor and the roller so that the rotation of the rotor rotates the roller, a working fluid can be compressed within the compression space. However, in this patent, too, the stationary shaft and the inner surface of the roller are in sliding contact, and thus a high relative speed exists therebetween. Therefore, this patent still has the problem of the conventional rotary compressor.

International Laid-Open Publication (WO) No. 2008-004983 discloses a rotary compressor of another type, which comprises a cylinder, a rotor being eccentrically mounted relative to the cylinder on the inside of the cylinder, and a vane mounted in a slot in the rotor for sliding movement relative to the rotor, the vane being securely connected to the cylinder to force the cylinder to rotate with the rotor, thereby compressing a working fluid within the compression space formed between the cylinder and the rotor. In this publication, however, the rotor rotates by a driving force received from the driving shaft, so that it is necessary to install a separate electric motor part for driving the rotor. That is to say, the rotary compressor according to this publication is problematic in that the height of the compressor is inevitably large be cause a separate electric motor part has to be laminated in a height direction relative to a compression mechanism part including a rotor, a cylinder, and a vane, thereby making a compact design difficult.

DISCLOSURE OF INVENTION

Technical Problem

The present invention has been made in an effort to solve the above-mentioned problems occurring in the prior art, and an object of the present invention is to provide a compressor which enables a compact design by forming a compression space within a compressor by a rotor of an electric motor part driving the compressor, and minimizes friction loss by redwing the relative speed between the rotating elements within the compressor.

Another object of the present invention is to provide a compressor which has a structure capable of minimizing leakage of refrigerant within a compression space.

Technical Solution

To achieve the above-mentioned objects of the present invention, according to one aspect of the present invention, a compressor comprises: a stator; a first rotary member rotating around a first rotary shaft longitudinally extending concentrically with the center of the stator by a rotating electromagnetic field from the stator; a second rotary member for compressing a refrigerant in a compression space formed between the first and second rotary members while rotating around a second rotary shaft upon receipt of a rotational force from the first rotary member; and a vane for transmitting the rotational force to the second rotary member from the first rotary member, and partitioning the compression space into a suction region for sucking the refrigerant and a compression region for compressing/discharging the refrigerant.

According to another aspect of the present invention, a compressor comprises: a stator; a first rotary member rotating, within the stator, around a first rotary shaft longitudinally extending concentrically with the center of the stator by a rotating electromagnetic field from the stator; a second rotary member for compressing a refrigerant in a compression space formed between the first and second rotary members while rotating, within the first rotary member, around a second rotary shaft upon receipt of a rotational force from the first rotary member; and a vane for transmitting the rotational force to the second rotary member from the first rotary member, and partitioning the compression space into a suction region for sucking the refrigerant and a compression region for compressing/discharging the refrigerant.

Here, the center line of the second rotary shaft may be spaced apart from the center line of the first rotary shaft.

Here, the longitudinal center line of the second rotary member may coincide with the center line of the second rotary shaft.

Here, the longitudinal center line of the second rotary member may be spaced apart from the center line of the second rotary shaft.

Alternatively, the center line of the second rotary shaft may coincide with the center line of the first rotary shaft, and the longitudinal center line of the second rotary member may be spaced apart from the center lines of the first rotary shaft and second rotary shaft.

Additionally, the vane may be integrally formed with the second rotary member, the first rotary member comprising: a vane mounting device; and bushes provided in the vane mounting device, for guiding the reciprocating motion of the vane within the vane mounting device of the first rotary member along with the rotation of the first rotary member and second rotary member.

Additionally, the vane may be integrally formed with the first rotary member, the second rotary member comprising: a vane mounting device; and bushes provided in the vane mounting device, for guiding the reciprocating motion of the vane within the vane mounting device of the second rotary member along with the rotation of the first rotary member and second rotary member.

Additionally, the vane mounting device may be penetrated in a longitudinal direction so as to communicate with the inner peripheral surface of the rotary member, and the bushes may be provided in one pair so as to be in contact with both sides of the vane.

Additionally, the vane may extend in a radial direction of the rotary member so as to face the center of the rotary shaft, and the bushes and a vane mounting device may guide the vane to reciprocate in the radial direction of the rotary member.

Additionally, the vane may extend in a radial direction of the rotary member so as to face the center of the rotary shaft, and the bushes and a bush mounting device may guide the vane to reciprocate in the radial direction of the rotary member.

Additionally, the vane may be hingeably coupled to the second rotary member and inserted into a groove formed on the first rotary member, and the vane may reciprocate within the groove according to the rotation of the first rotary member and the second rotary member.

Additionally, the vane may be hingeably coupled to the first rotary member and inserted into a groove formed on the second rotary member, and the vane may reciprocate within the groove according to the rotation of the first rotary member and the second rotary member.

Additionally, first and second covers may be further provided which are located in the axial direction of the first rotary member and second rotary member, and form a compression space between the first rotary member and the second rotary member while integrally rotating with one of the first and second rotary members.

Additionally, the compressor may further comprise a bearing member which is provided inside the hermetically sealed container and fixed to the inside of the hermetically sealed container, for rotatably supporting the rotary member including the first and second covers.

Additionally, the bearing member may rotatably support the first cover and the second cover, while being fixed to the hermetically sealed container.

Additionally, the first rotary member may further comprise a first cover and a second cover coupled to upper and lower parts of the first rotary member and integrally rotating with the first rotary member so as to form a compression space between the first and second rotary members, and the second rotary member may further comprise a roller forming a compression space together with the first rotary member and a second rotary shaft rotating integrally with the roller and extending to one or more of the first and second covers.

Additionally, the compressor may further comprise a bearing member provided in the hermetically sealed container, and for rotatably supporting the first and second covers and the second rotary shaft, being fixed to the inside of the hermetically sealed container.

Additionally, the compressor may further comprise a suction path which is formed to penetrate part of the second rotary shaft and part of the second rotary member.

Additionally, the compressor may further comprise a discharge path which is formed to penetrate part of the first rotary shaft.

Additionally, the compressor may further comprises: a refrigerant suction/discharge path penetrating the first rotary shaft and the second rotary shaft; and an oil supply path isolated from the refrigerant suction/discharge path.

Additionally, the compressor may further comprise: a first cover and a second cover which are located at upper and lower parts of the first rotary member and second rotary member, and forming a compression space between the first and second rotary members while rotating integrally with the first rotary member; and a means for fixing the bushes to one or more of the first and second covers.

Additionally, the compressor may further comprise: a first cover and a second cover which are located at upper and lower parts of the first rotary member and second rotary member, and forming a compression space between the first and second rotary members while rotating integrally with the first rotary member; and a means for fixing the vane to one or more of the first and second covers.

Additionally, the fixing means may be a pin which is inserted so as to penetrate fastening grooves formed on the first and second covers and a tip end portion of the vane.

Advantageous Effects

The thus-constructed compressor according to the present invention can enables a compact design because a compression space within the compressor is formed by a rotor of an electric motor part driving the compressor by installing a compression mechanism part and the electric motor part in a radius direction, thus minimizing the height of the compressor and reducing the size, and can significantly decrease a difference in relative speed between the first rotary member and the second rotary member and hence minimize a resulting friction loss because a refrigerant is compressed in the compression space between the first and second rotary members as the first rotary member rotates along with the second rotary member by transmitting a rotational force to the second rotary member, thus maximizing the efficiency of the compressor.

Furthermore, since the vane partitions the compression space while reciprocating between the first rotary member and the second rotary member without being in sliding contact with first rotary member or second rotary member, the leakage of the refrigerant in the compression space can be minimized by means of a simple structure, thereby maximizing the efficiency of the compressor.

Moreover, the first bearing and the second bearing include journal bearings being in contact with the inner peripheral surface of the first rotary shaft and the outer peripheral surface of the second rotary shaft, and for rotatably supporting them and thrust bearings being in contact with surfaces contacting the second rotary member and the covers in a load direction, and for rotatably supporting them, whereby the rotation of the rotary members can be firmly supported.

Moreover, as the bushes or vane for transmitting the rotational force of the first rotary member to the second rotary member is coupled to one of the first and second covers by pins, which is a fixing means, the rotational force of the first rotary member integrally rotating with one of the first and second covers is more efficiently transmitted to the second rotary member, thereby realizing an efficient compressor.

MODE FOR THE INVENTION

Hereinafter, embodiments of the present invention will be described in detail with reference to the accompanying drawings.

Figure 1:
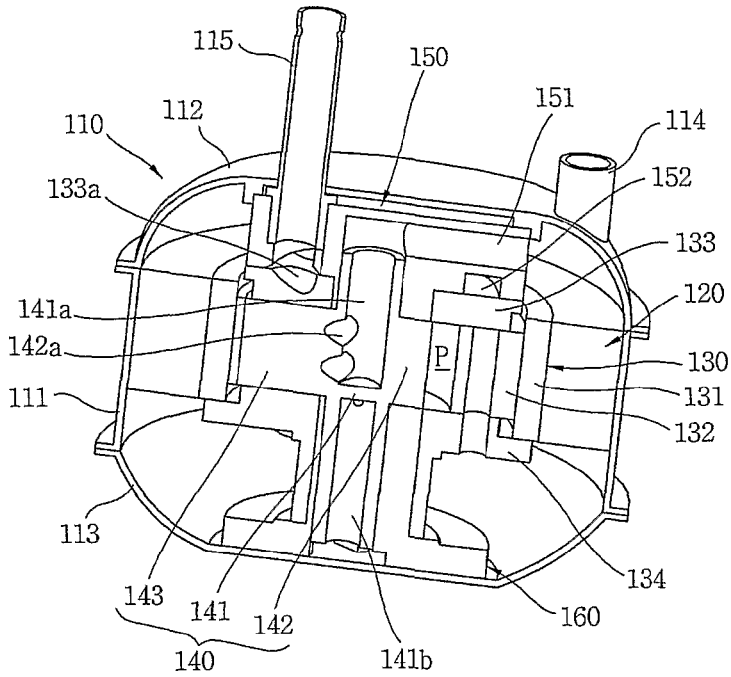
FIG. 1 is a side cross sectional view showing a first embodiment of a compressor according to the present invention.
Figure 2:
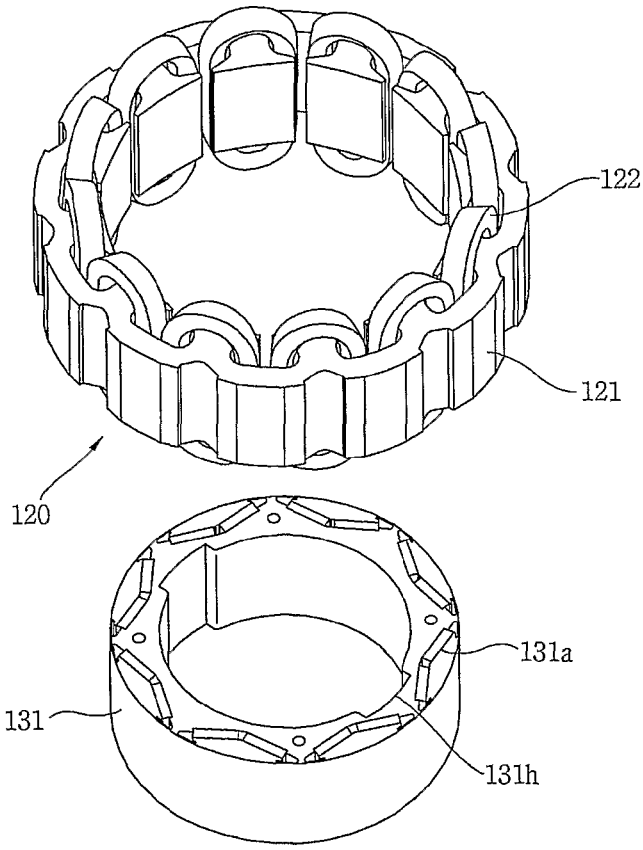
FIG. 2 is an exploded perspective view showing one example of an electric motor part in the first embodiment of the compressor according to the present invention.
Figure 3:
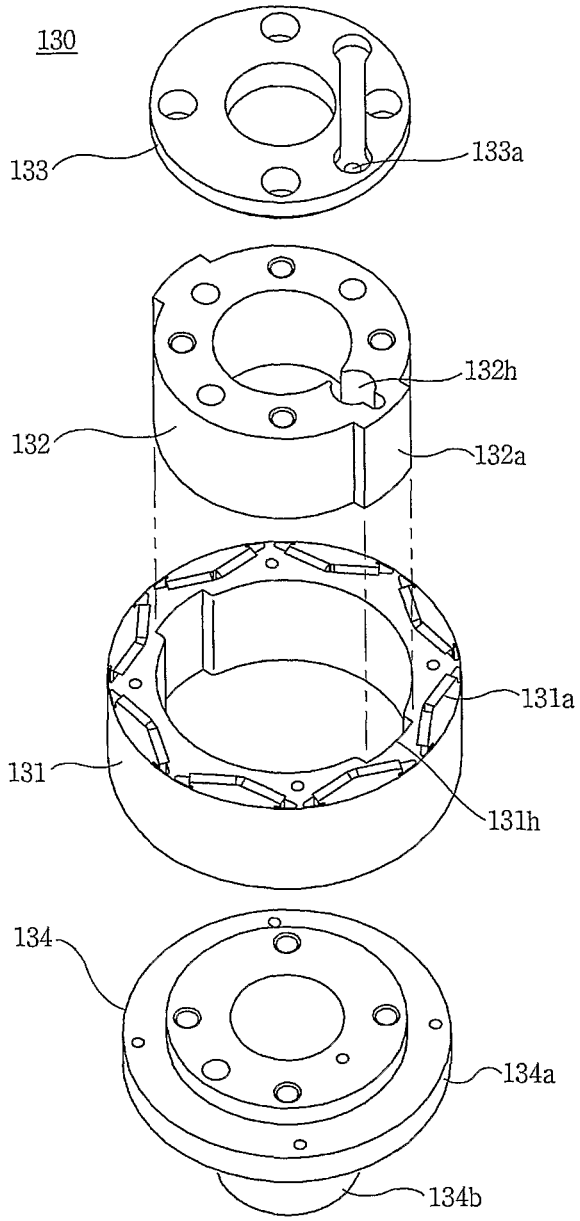
FIGS. 3 and 4 are exploded perspective views showing one example of a compression mechanism part in the first embodiment of the compressor according to the present invention.
Figure 4:
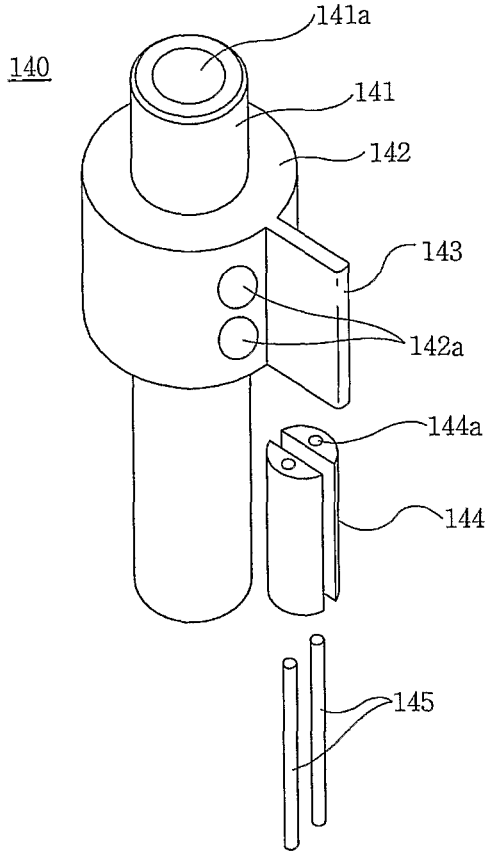

FIG. 1 is a side cross sectional view showing a first embodiment of a compressor according to the present invention. FIG. 2 is an exploded perspective view showing one example of an electric motor part in the first embodiment of the compressor according to the present invention. FIGS. 3 and 4 are exploded perspective views showing one example of a compression mechanism part in the first embodiment of the compressor according to the present invention.

The first embodiment of the compressor according to the present invention comprises, as shown in FIG. 1, a hermetically sealed container 110, a stator 120 installed inside the hermetically sealed container 110, a first rotary member 130 rotatably installed inside the stator 120 by a rotational electromagnetic field from the stator 120, a second rotary member 140 for compressing a refrigerant between the first and second rotary members 130 and 140 while rotating inside the first rotary member 130 upon receipt of a rotational force from the first rotary member 130, and first and second bearings 150 and 160 for rotatably supporting the first rotary member 130 and the second rotary member 140 on the inside of the hermetically sealed container 110. An electric motor part for providing electric power by an electrical action employs a kind of BLDC motor including a stator 120 and a first rotary member 130, and a compression mechanism part for compressing the refrigerant by a mechanical action includes a first rotary member 130, a second rotary member 140, and first and second bearings 150 and 160. Thus, the overall height of the compressor can be decreased by installing the electric motor part and the compression mechanism part in a radius direction. Although the embodiments of the present invention are described by way of example of a so-called 'inner rotor type' defining a compression mechanism part at the inside of an electric motor part, those skilled in the art will readily understand that the aforementioned concept can be easily applied to a so-called 'outer rotor type' defining a compression mechanism part at the outside of an electric motor part.

As shown in FIG. 1, the hermetically sealed container 110 includes a cylindrical body portion 111 and upper and lower shells 112 and 113 coupled to upper and lower parts of the body portion 111, and can store oil for lubricating the first and second rotary members 130 and 140 (shown in FIG. 1) therein to an appropriate height. A suction pipe 114 for sucking the refrigerant is provided at a predetermined position of the upper shell 112, and a discharge pipe 115 for discharging the refrigerant is provided at another predetermined position of the upper shell 113. The type of the compressor is determined as a high pressure type or a low pressure type according to whether the inside of the hermetically sealed container 110 is filled with a compressed refrigerant or a refrigerant before compression, and accordingly the positions of the suction pipe 114 and discharge pipe 115 are determined. In the first embodiment of the present invention, the compressor is configured as the low pressure type. To this end, the suction pipe 114 is connected to the hermetically sealed container 110, and the discharge pipe 115 is connected to the compression mechanism part. Therefore, when a low pressure refrigerant is sucked through the intake pipe 114, the refrigerant is introduced into the compression mechanism part, being filled in the hermetically sealed container 110, and a high pressure refrigerant compressed in the compression mechanism part is directly discharged out through the discharge pipe 115.

As shown in FIG. 2, the stator 120 includes a core 121 and a coil 122 concentratedly wound around the core 121. The core employed in a conventional BLDC motor has 9 slots along the circumference, while, in a preferred embodiment of the present invention, the core 121 of a BLDC motor has 12 slots along the circumference because the diameter of the stator is relatively larger. The more the slots of the core, the larger the number of turns of the coil. Thus, in order to generate an electromagnetic force of the stator 120 identical to that in the prior art, the height of the core 12 may be decreased.

As shown in FIG. 3, the first rotary member 130 includes a rotor unit 131, a cylinder unit 132, a first cover 133, and a second cover 134. The rotor unit 131 is formed in the shape of a cylinder which rotates within the stator 120 (shown in FIG. 1) by a rotation magnetic field with the stator 120 (shown in FIG. 1), and has a plurality of permanent magnets 131*a* inserted therein in an axial direction so as to generate a rotation magnetic field. Like the rotor unit 131, the cylinder unit 132 is also formed in the shape of a cylinder so as to form a compression space P (shown in FIG. 1) therein. The rotor unit 131 and the cylinder unit 132 may be coupled to each other after they are separately manufactured. In one example, a pair of mounting projections 132*a* are provided on the outer peripheral surface of the cylinder unit 132, and mounting grooves 131*h* having a shape corresponding to the mounting projections 132*a* of the cylinder unit 132 are provided on the inner peripheral surface of the rotor unit 131, so that the outer peripheral surface of the cylinder unit 132 matches in shape with the inner peripheral surface of the rotor unit 131. More preferably, the rotor unit 131 and the cylinder unit 132 may be integrally manufactured. In this case, similarly, the permanent magnets 131*a* are mounted to holes additionally formed in the axial direction.

The first cover 133 and the second cover 134 are coupled to the rotor unit 131 and/or cylinder unit 132 in the axial direction. A compression space P (shown in FIG. 1) is formed between the cylinder unit 132 and the first and second covers 133 and 134. The first cover 133 has a flat plate shape, and includes a discharge opening 133*a* for letting out a compressed refrigerant compressed in the compression space P (shown in FIG. 1) and a discharge valve (not shown) mounted on the discharge opening 133*a*. The second cover 134 includes a flat plate-shaped cover portion 134*a* and a hollow shaft portion 134*b* projecting downwards at the center thereof. Though the hollow shaft portion 134*b* may be omitted, the provision of the hollow shaft portion 134*b* applying a load causes an increase in contact surface with the second bearing 160 (shown in FIG. 1), thereby rotatably supporting the second cover 134 more stably. Hereupon, the first and second covers 133 and 134 are bolted to the rotor unit 131 or cylinder unit 132 in the axial direction, and hence the rotor unit 131, the cylinder unit 132, and the first and second covers 133 and 134 rotate integrally with each other.

Figure 5:
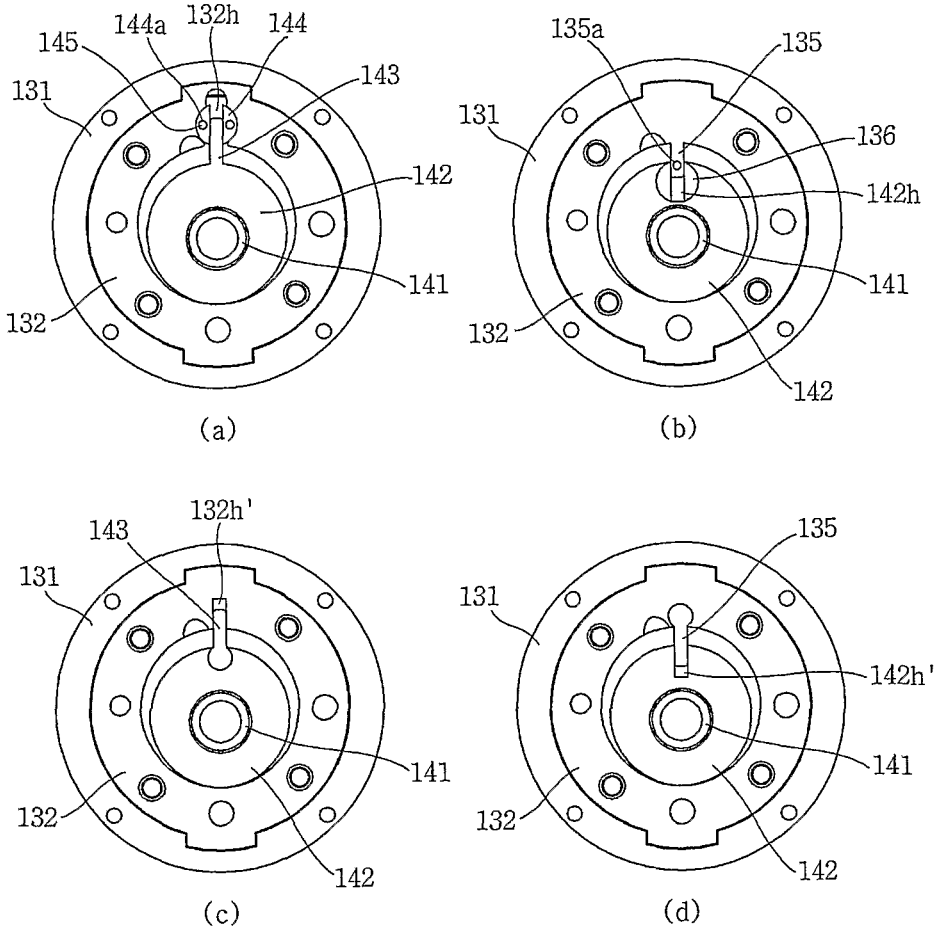
FIGS. 5 and 6 are plane views showing one example of a vane mounting device and the operation cycle of the compression mechanism part in the first embodiment of the present invention.

As shown in FIG. 4, the second rotary member 140 includes a rotary shaft 141, a roller 142, and a vane 143. The rotary shaft 141 axially extends on both axial sides of the roller 142, and a portion projecting on the bottom surface of the roller 142 is longer than a portion projecting on the top surface of the roller 142, so that the rotary shaft 141 is stably supported even if a load is applied thereto. Preferably, the rotary shaft 141 and the roller 142 may be integrally formed. Even if they are separately formed, they should be coupled to each other so as to rotate integrally with each other. Advantageously, the rotary shaft 141 is formed in the shape of a hollow shaft whose middle portion is blocked so that a suction path 141*a* for sucking a refrigerant and an oil supply unit 141*b* (shown in FIG. 1) for pumping oil are separately configured to minimize the mixing of the oil and refrigerant. On the oil supply unit 141*b* of the rotary shaft 141, a spiral member for helping the oil rise by a rotational force may be mounted, or grooves for helping the oil rise by a capillary tube phenomenon may be formed. On the rotary shaft 141 and the roller 142, various types of oil supply holes (not shown) and oil storage grooves (not shown) are provided to supply the oil supplied through the oil supply unit 141*b* (shown in FIG. 1) between two or more members where a sliding action occurs. The roller 142 is provided with a suction path 142*a* penetrated in a radial direction so as to communicate the suction path 141*a* of the rotary shaft 141 with the compression space P (shown in FIG. 1). The refrigerant is sucked into the compression space P (shown in FIG. 1) through the suction path 141*a* of the rotary shaft 141 and the suction path 142*a* of the roller 142. The vane 143 is provided extending in a radial direction on the outer peripheral surface of the roller 142, and is installed so as to be rotatable at a predetermined angle while reciprocating within a vane mounting device 132*h* of the first rotary member 130 (shown in FIG. 5) by a pair of bushes 144. As shown in FIG. 5, the bushes 144 guide the vane 143 to reciprocate through a space formed between the pair of bushes 144 mounted within the vane mounting device 132*h* (shown in FIG. 5) while restricting the circumferential rotation of the vane 143 to less than a predetermined angle. Although oil may be supplied so as to lubricate the bushes 144 even if the vane 143 reciprocates within the bushes 144, the bushes 144 themselves may be made of a self-lubricating material. In one example, the bushes 144 may be made of a material, which is sold under the trade name of Vespel SP-21. The Vespel SP-21 is a polymer material, and is excellent in abrasion resistance, heat resistance, self-lubricating characteristics, burning resistance, and electric insulation.

Figure 6:
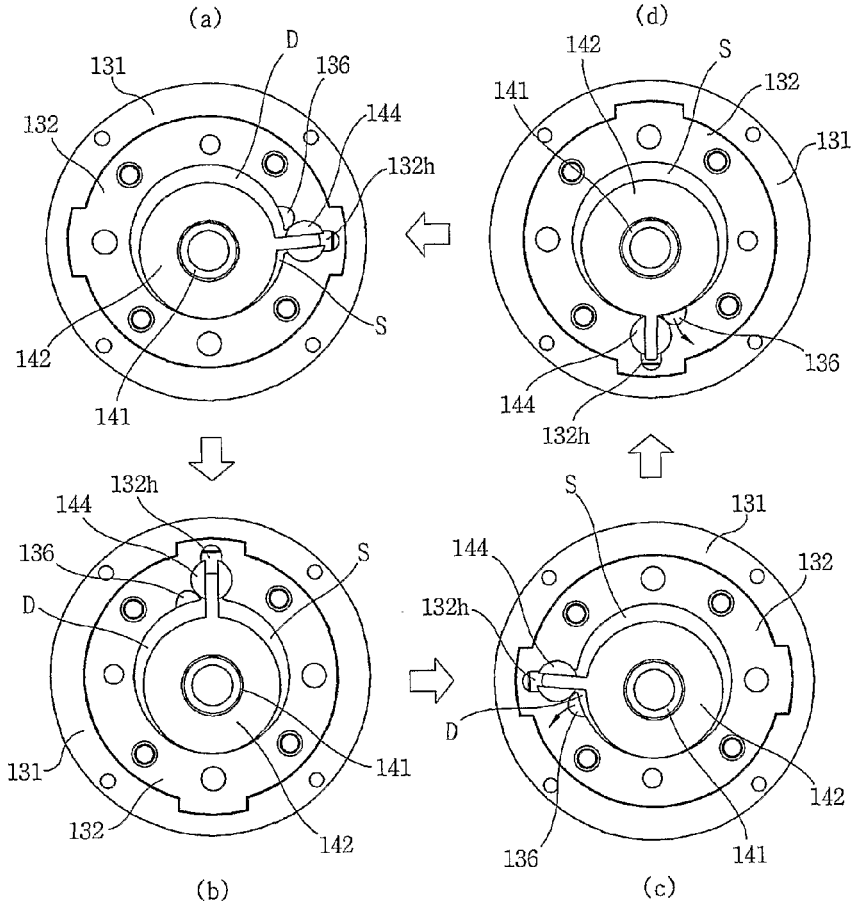

FIGS. 5 and 6 are plan views showing various embodiments of a vane mounting structure of the compressor and a compression cycle of the compression mechanism part according to the present invention. FIG. 5(*a*) is a view showing a vane integrally formed with the second rotary member, and FIG. 5(*b*) is a view showing a vane integrally formed with the first rotary member. FIG. 5(*c*) is a view showing the vane hingeably coupled with the second rotary member, and FIG. 5(*d*) is a view showing the vane hingeably coupled with the first rotary member.

The mounting structure of the vane 143 will be described with reference to FIG. 5. The vane mounting device 132*h* longitudinally formed is provided on the inner peripheral surface of the cylinder unit 132, the pair of bushes 144 are fitted into the vane mounting device 132*h*, and then the vane 143 integrally formed with the rotary shaft 141 and the roller 142 is fitted between the bushes 144. Hereupon, a compression space P (shown in FIG. 1) is provided between the cylinder unit 132 and the roller 142, and the compression space P (shown in FIG. 1) is divided into a suction region S and a discharge region D by the vane 143. The suction path 142*a* (shown in FIG. 1) of the roller 142 as explained above is located in the suction region S, and the discharge opening 133*a* (shown in FIG. 1) of the first cover 133 (shown in FIG. 1) is located in the discharge region D. The suction path 142*a* (shown in FIG. 1) of the roller 142 and the discharge opening 133*a* (shown in FIG. 1) of the first cover 133 (shown in FIG. 1) are located so as to communicate with a sloped discharge portion 136 in a position adjacent to the vane 143. In this manner, the vane 143 integrally manufactured with the roller 142 in the compressor is assembled between the bushes 144 so as to be slidably movable, and this can reduce friction loss by a sliding contact and reduce refrigerant leakage between the action region S and the discharge region D, compared to a conventional rotary compressor in which a vane manufactured separately from a roller or cylinder is supported by a spring.

Accordingly, when the rotor unit 131 receives a rotational force by the rotation magnetic field with the stator 120 (shown in FIG. 1), the rotor unit 131 and the cylinder unit 132 rotate. The vane 143 transmits the rotational force of the rotor unit 131 and cylinder unit 132 to the roller 142, being fitted into the cylinder unit 132. At this time, by quantum rotation, the vane 143 reciprocates between the bushes 144. That is to say, the inner surfaces of the rotor unit 131 and cylinder unit 132 have portions corresponding to the outer surface of the roller 142. As these corresponding portions are brought into contact with and spaced apart from the rotor unit 131 and the cylinder unit 132 in a repetitive manner each time the roller 142 rotates once, the suction region S becomes gradually larger and a refrigerant or working fluid is sucked into the suction region, and at the same time the discharge region D becomes gradually smaller and the refrigerant or working fluid therein is compressed and then discharged.

In FIG. 5(*a*), the first rotary member 130 is coupled to one or more of the first cover 133 and the second cover 134 and integrally rotates therewith, and includes the vane mounting device 132*h*. When the first rotary member 130 and the second rotary member 140 integrally rotate, the vane 143 reciprocates within the vane mounting device 143*h* of the first rotary member 130. The bushes 144 are provided in the vane mounting device 132*h* in order to guide the reciprocating motion and the bushes 144 are provided in one pair on the vane mounting device 132*h* so as to be in contact with both sides of the vane 143. The bushes 144 have through holes 144*a* longitudinally formed thereon, and may be fixed to either one of the first cover 133 and second cover 134 by a fixing means. Fastening grooves 138 are formed on the first cover 133 and second cover 134 to receive the fixing means. As the fixing means, pins 145 to be inserted into the through holes 144*a* and fitted into one of the first and second covers 133 and 134 are preferred. A gap exists between the vane mounting device 132*h* and the bushes 144, and the pins 145 and the bushes 144 are not press-fitted, which enables oscillation. Thus, there is no problem in the integral rotation of the first rotary member and the second rotary member. Therefore, the rotational force of the first rotary member 130 can be more efficiently transmitted to the second rotary member 140 through the vane 143.

As shown in FIG. 5(*b*), the first rotary member 130 includes a vane 135 extending from the inner peripheral surface and formed in an axial direction. The second rotary member 140 includes a vane mounting device 142*h* and bushes 144 for guiding the reciprocating motion of the vane 135 within the vane mounting device 142*h* according to the rotation of the first rotary member 130. The bushes 144 are provided in on pair in the vane mounting device 142*h* so as to be in contact with both sides of the vane 135. As stated above, since the first rotary member 130 is coupled to one or more of the first and second covers 133 and 134 and integrally rotates therewith, the first rotary member 130 can be fixed to one or more of the first and second covers 133 and 134 by a fixing means by forming a longitudinal through hole 135*a* at a tip end portion of the vane 135. Fastening grooves for receiving the fixing means are formed on the first cover 133 and the second cover 134. As the fixing means, a pin to be inserted into the through hole 135*a* and fitted to at least one of the first and second covers 133 and 134 are preferred.

FIGS. 5(*c*) and 5(*d*) show the vanes 135 hingeably coupled to the second rotary member and the first rotary member, the vanes 143 and 135 being inserted into grooves 132*h*' and 142*h*' formed on the first rotary member 130 and the second rotary member 140. According to the rotation of the first rotary member 130 and the second rotary member 140, the vanes reciprocate within the grooves 132*h*' and 142'. In (c), the vane 143 is hingeably coupled to the second rotary member 140, and fitted into the groove 132W formed on the first rotary member 130. In (d), as the vane 135 is coupled to the first rotary member 130, if the first rotary member 130 and the second rotary member 140 integrally rotate, the vane 135 reciprocates with the second rotary member 140 and the first rotary member 130. Here, since a gap exists between the vanes 143 and 135 and the grooves 132W and 142W and the hinges are rotatable, the first rotary member 130 and the second rotary member 140 integrally rotate. To couple the hinges of the vanes 143 and 135 to the first rotary member 130 or second rotary member 140, longitudinal holes connected to the inner peripheral surface of the cylinder unit 132 and the outer peripheral surface of the roller are formed to fasten the hinges.

FIG. 6 is a view showing the suction, compression, discharge cycle of the compression mechanism part. In FIG. 6(*a*), a refrigerant or working fluid is sucked into the suction region S and compression occurs in the discharge region D. When the first and second rotary members reach (b), the refrigerant or working fluid is sucked into the suction region S, and compression, too, continues to occur. In (c), suction into the suction region S continues to occur, and if the pressure of the refrigerant or working fluid is more than a set pressure value, the refrigerant or working fluid in the discharge region D is discharged through the sloped discharge portion 136. In (d), the suction and discharge of the refrigerant or working fluid are almost over. In this way, FIGS. 6(*a*) to 6(*d*) show one cycle of the compression mechanism part.

Figure 7:
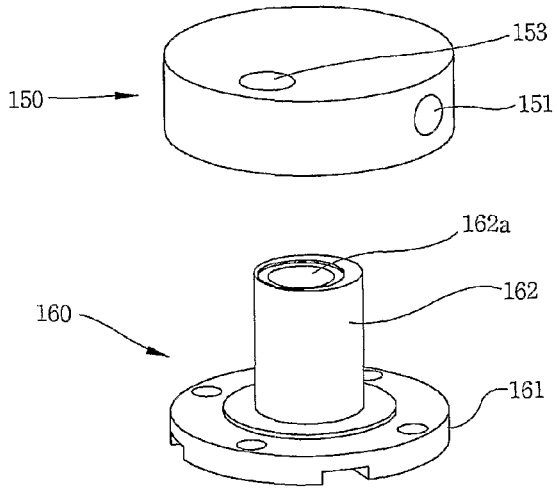
FIG. 7 is an exploded perspective view showing one example of a support member in the first embodiment of the compressor according to the present invention.

FIG. 7 is an exploded perspective view showing one example of a support member of the compressor according to the present invention.

The first and second rotary members 130 and 140 as described above are supported so as to be rotatable inside the hermetically sealed container 110 by the first and second bearings 150 and 160 coupled in the axial direction as shown in FIGS. 1 to 7. The first bearing 150 may be fixed by a fixing rib or fixing projection projecting from the upper shell 112, and the second bearing 160 may be bolted to the lower shell 113.

The first bearing 150 includes a journal bearing for rotatably supporting the outer peripheral surface of the rotary shaft 141 and the inner peripheral surface of the first cover 133 and a thrust bearing for rotatably supporting the top surface of the first cover 133. The first bearing 150 is provided with a suction guide path 151 communicating with the suction path 141*a* of the rotary shaft 141. The suction guide path 151 is configured to communicate with the inside of the hermetically sealed container 110 such that the refrigerant nuked into the hermetically sealed container 110 is sucked through the suction pipe 114. Further, the first bearing 150 is provided with a discharge guide path 152 communicating with the discharge opening 133*a* of the first cover 133. The discharge guide path 152 is configured in the form of a ring or circular groove for receiving the rotation trajectory of the discharge opening 133*a* of the first cover 133 even when the discharge opening 133*a* of the first cover 133 rotates. Of course, the discharge guide path 152 is provided with a discharge mounting device 153 to directly connect with the discharge pipe 115 so that the refrigerant is directly discharged out.

The second bearing 160 includes a journal bearing for rotatably supporting the outer peripheral surface of the rotary shaft 141 and the inner peripheral surface of the second cover 134 and a thrust bearing for rotatably supporting the bottom surface of the roller 142 and the bottom surface of the second cover 134. The second bearing 160 includes a flat plate-shaped support portion 161 bolted to the lower shell 113 and a shaft portion 162 provided with a hollow portion 162*a* projecting upwards at the center of the support portion 161. At this time, the center of the hollow portion 162*a* of the second bearing 160 is located eccentrically from the center of the shaft portion 162 of the second bearing 160. While the center of the shaft portion 162 of the second bearing 160 coincides with the rotational center line of the first rotary member 130, the center of the hollow portion 162*a* of the second bearing 160 coincides with the center line of the rotary shaft 141 of the second rotary member 140. That is to say, the center line of the rotary shaft 141 of the second rotary member 140 may be formed eccentrically with respect to the rotational center line of the first rotary member 130, or may be formed concentrically according to the location of the longitudinal center line of the roller 142. This will be described in detail below.

Figure 8:
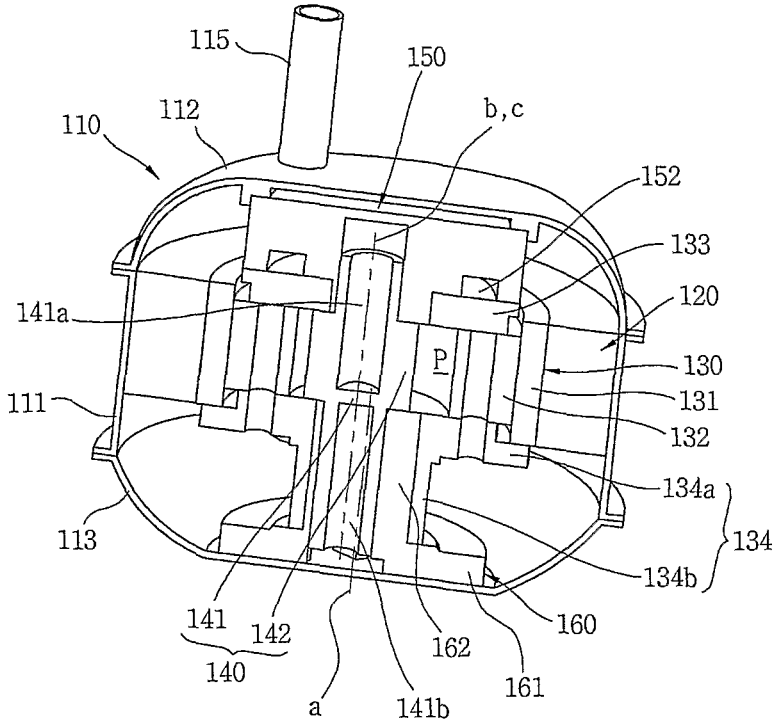
FIGS. 8 to 10 are side cross sectional views showing a rotational center line of the first embodiment of the compressor according to the present invention.
Figure 9:
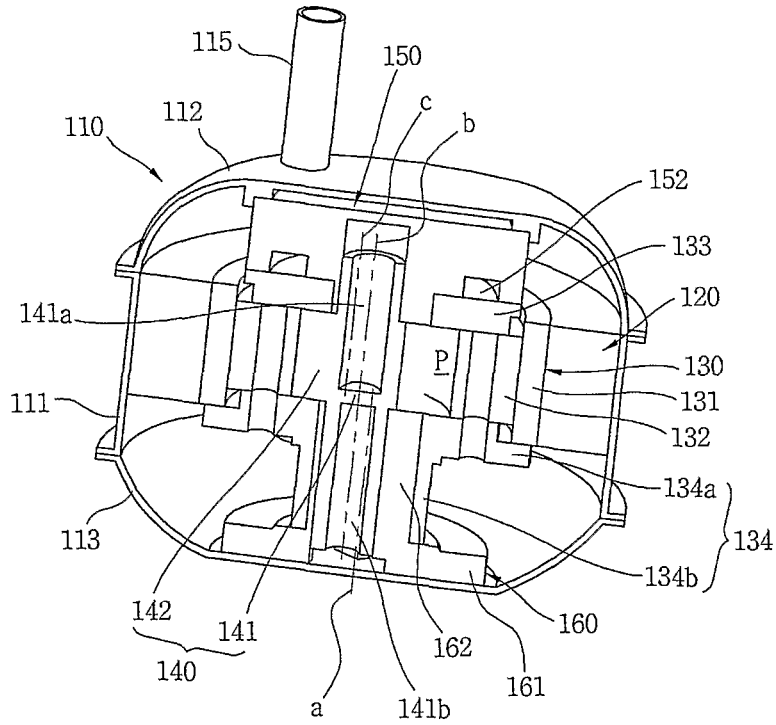
Figure 10:
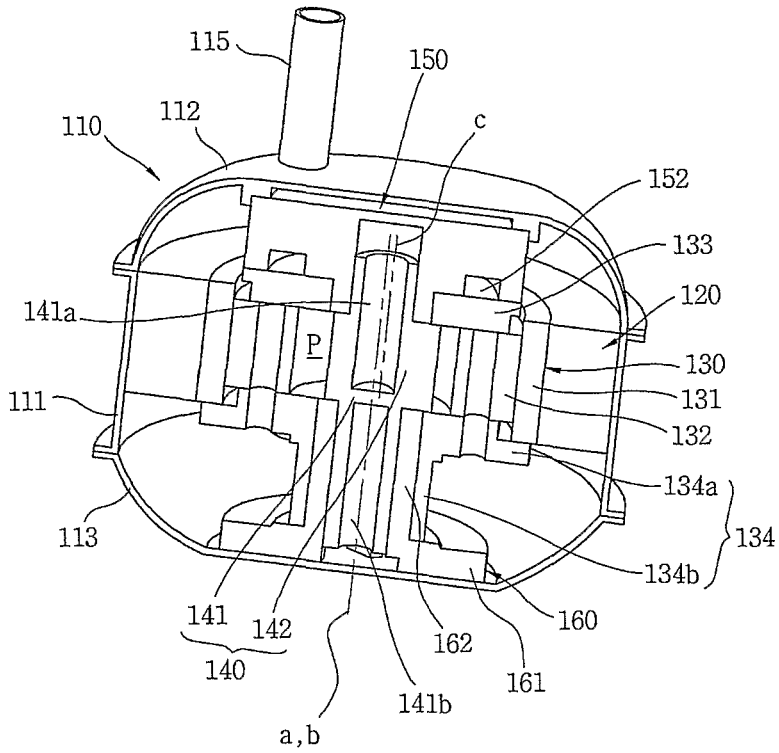

FIGS. 8 to 10 are side cross sectional views showing a rotational center line of the first embodiment of the compressor according to the present invention.

The second rotary member 140 is located eccentrically with respect to the first rotary member 130 so as to compress the refrigerant while the first and second rotary members 130 and 140 simultaneously rotate. The relative locations of the first and second rotary members 130 and 140 will be described with reference to FIGS. 8 to 10. Hereupon, a denotes the center line of a first rotary shaft of the first rotary member 130, and may also be regarded as the longitudinal center line of the shaft portion 134*b* of the second cover 134 and the longitudinal center line of the shaft portion 162 of the bearing 160. Here, since the first rotary member 130 includes the rotor unit 131, the cylinder unit 132, the first cover 133, and the second cover 134 and rotate integrally with each other, as shown in FIG. 3, a may be regarded as their rotational center lines. b denotes the center line of a second rotary shaft of the second rotary member 140, and may also be regarded as the longitudinal center line of the rotary shaft 141. c denotes the longitudinal center line of the second rotary member 140, and may also be regarded as the longitudinal center line of the roller 142.

In a preferred embodiment according to the present invention as shown in FIGS. 1 to 7, the center line b of the second rotary shaft is spaced a predetermined gap apart from the center line a of the first rotary shaft, and the longitudinal center line c of the second rotary member 140 coincides with the center line b of the second rotary shaft. Thus, the second rotary member 140 is configured to be eccentric with respect to the first rotary member 130, and when the first and second rotary members 130 and 140 rotate by the medium of the vane 143, the second rotary member 140 and the first rotary member 130 are brought into contact with or spaced apart from each other per one rotation in a repetitive manner as stated above, so that the volumes of the suction region S and the discharge region D in the compression space P are varied to thus compress the refrigerant.

As shown in FIG. 9, the center line b of the second rotary shaft is spaced a predetermined gap apart from the center line a of the first rotary shaft, and the longitudinal center line c of the second rotary member 140 is spaced a predetermined gap apart from the center line b of the second rotary shaft, and the center line a of the first rotary shaft and the longitudinal center line c of the second rotary member 140 do not coincide with each other. Similarly, the second rotary member 140 is configured to be eccentric with respect to the first rotary member 130, and when the first and second rotary members 130 and 140 rotate together by the medium of the vane 143, the second rotary member 140 and the first rotary member 130 are brought into contact with or spaced apart from each other per one rotation in a repetitive manner as stated above, so that the volumes of the suction region S and the discharge region D in the compression space P are varied to thus compress the refrigerant. It may be possible to provide a larger eccentric amount than in FIG. 7*a*.

As shown in FIG. 10, the center line b of the second rotary shaft coincides with the center line a of the first rotary shaft, as shown in FIG. 8, and the longitudinal center line of the second rotary member 140 is spaced a predetermined gap apart from the center line a of the first rotary shaft and the center line b of the second rotary shaft. Similarly, the second rotary member 140 is configured to be eccentric with respect to the first rotary member 130, and when the first and second rotary members 130 and 140 rotate together by the medium of the vane 143, the second rotary member 140 and the first rotary member 130 are brought into contact with or spaced apart from each other per one rotation in a repetitive manner as stated above, so that the volumes of the suction region S and the discharge region D in the compression space P are varied to thus compress the refrigerant.

Figure 11:
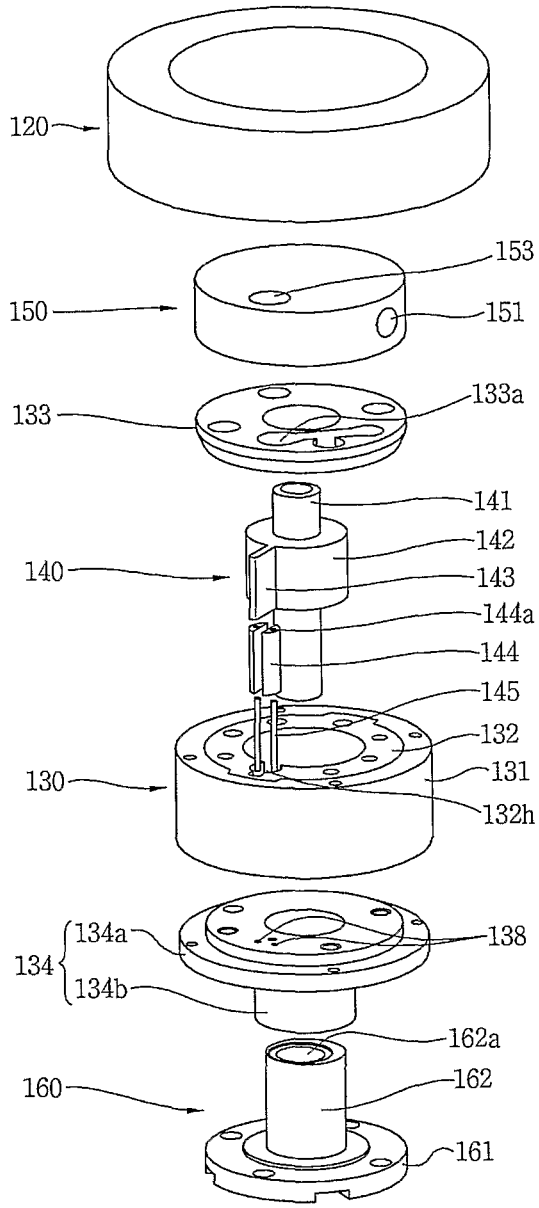
FIG. 11 is an exploded perspective view showing the first embodiment of the compressor according to the present invention.

FIG. 11 is an exploded perspective view showing the first embodiment of the compressor according to the present invention.

Describing one example of coupling in the first embodiment of the compressor according to the present invention with reference to FIGS. 1 to 11, the rotor unit 131 and the cylinder unit 132 may be separately manufactured and coupled to each other, or may be integrally manufactured. Although the rotary shaft 141, the roller 142, and the vane 143 may be integrally manufactured or separately manufactured, they are adapted to integrally rotate. The vane 143 is fitted to the inside of the cylinder unit 131 by the bushes 144, and the rotary shaft 141, the roller 142, and the vane 143 are mounted entirely on the inside of the rotor unit 131 and cylinder unit 132. The first and second covers 133 and 134 are bolt-coupled in the axial direction of the rotor unit 131 and cylinder unit 132, and installed so as to cover the roller 142 even if the rotary shaft 141 is penetrated.

In this manner, when a rotation assembly having the first and second rotary members 130 and 140 assembled therein is assembled, the second bearing 160 is bolted to the lower shell 113, and then the rotation assembly is assembled to the second bearing 160. The inner peripheral surface of the shaft portion 134*a* of the second cover 134 comes in contact with the outer peripheral surface of the shaft portion 162 of the second bearing 160, and the outer peripheral surface of the rotary shaft 141 is comes in contact with the hollow portion 162*a* of the second bearing 160. Afterwards, the stator 120 is press-fitted into the body portion 111, and the body portion 111 is coupled to the lower shell 112, and the stator 120 is located so as to maintain a gap on the outer peripheral surface of the rotation assembly. Thereafter, the first bearing 150 is coupled to the upper shell 112, and the discharge pipe 115 of the upper shell 112 is assembled so as to be press-fitted into the discharge pipe mounting device 143 (shown in FIG. 6) of the first bearing 150. In this manner, the upper shell 112 having the first bearing 150 assembled therein is coupled to the body portion 111, and the first bearing 150 is installed so as to be fitted between the rotary shaft 141 and the first cover 133 and, at the same time, to cover from above. Of course, the suction guide path 151 of the first bearing 150 communicates with the suction path 141*a* of the rotary shaft 141, and the discharge guide path 152 of the first bearing 150 communicates with the discharge opening 133*a* of the first cover 133.

Therefore, the rotation assembly having the first and second rotary members 130 and 140 assembled therein, the body portion 111 having the stator 120 mounted thereon, the upper shell 112 having the first bearing 150 mounted thereon, and the lower shell 113 having the second bearing 160 mounted thereon are coupled in the axial direction, the first and second bearings 150 and 160 are supported on the hermetically sealed container so as to make the rotation assembly rotatable in the axial direction.

Figure 12:
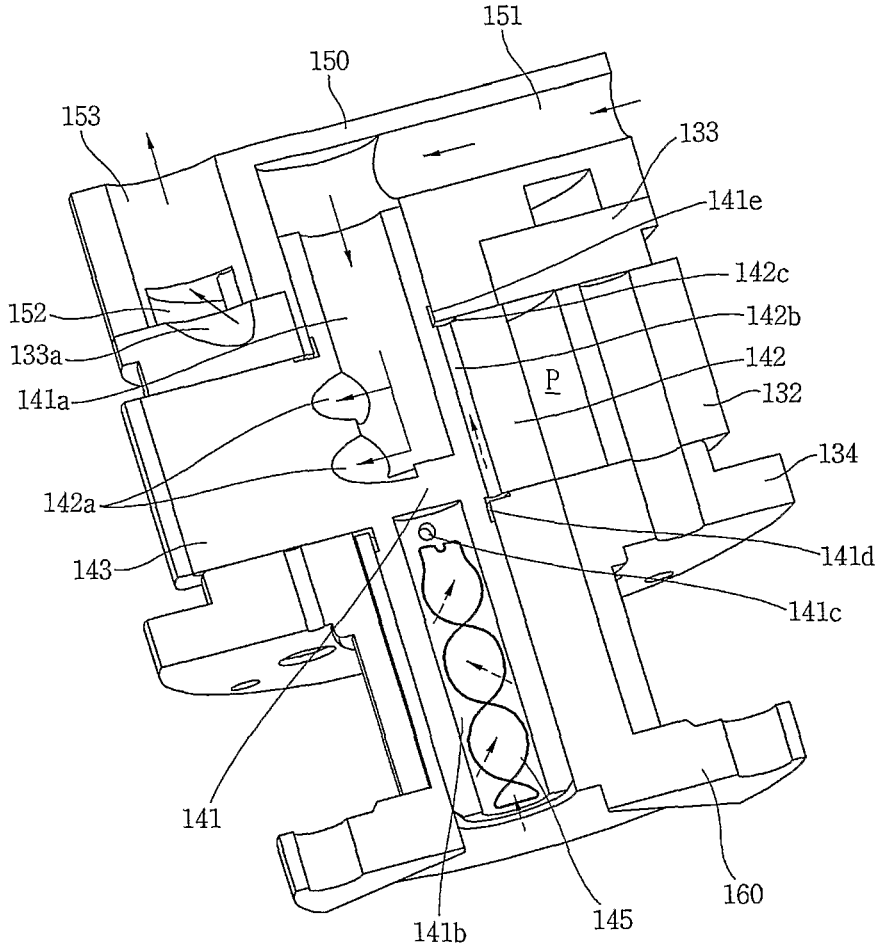
FIG. 12 is a side cross sectional view showing the movement of refrigerant and the flow of oil in the first embodiment of the compressor according to the present invention.

FIG. 12 is a side cross sectional view showing the movement of refrigerant and the flow of oil in the first embodiment of the compressor according to the present invention.

The operation of the first embodiment of the compressor according to the present invention will be described with reference to FIGS. 1 and 12. As current is supplied to the stator 120, a rotation magnetic field is generated between the stator 120 and the rotor unit 131. Then, by a rotational force of the rotor unit 131, the first rotary member 130, i.e., the rotor unit 131, cylinder unit 132, and first and second covers 133 and 134 integrally rotate. Hereupon, since the vane 134 is installed on the cylinder unit 131 so as to be reciprocatable, the rotational force of the first rotary member 130 is transmitted to the second rotary member 140, and the second rotary member 140, i.e., the rotary shaft 141, roller 142, and vane 143 integrally rotate. Hereupon, as shown in FIGS. 8 to 10, the first and second rotary members 130 and 140 are located eccentrically with respect to each other. Thus, as they are brought into contact with and spaced apart from each other per one rotation in a repetitive manner, the volumes of the suction region S and the discharge region D inside the compression space P are varied to thus compress the refrigerant, and at the same time oil is pumped to thus lubricate between the two members in sliding contact.

When the first and second rotary members 130 and 140 are rotated, the refrigerant is sucked, compressed, and discharged. More specifically, as the roller 142 and the cylinder unit 132 are brought into contact with and spaced apart from each other per one rotation in a repetitive manner, the volumes of the suction region S and discharge region D partitioned by the vane 143 inside the compression space P are varied to thus suck, compress, and discharge the refrigerant. In other words, as the volume of the suction region becomes gradually larger, the refrigerant is sucked into the suction region of the compression space P through the suction pipe 114 of the hermetically sealed container 110, the inside of the hermetically sealed container 110, the suction guide path 151 of the first bearing 150, the suction path 141*a* of the rotary shaft, and the suction path 142*a* of the roller 142. Thereafter, the refrigerant is compressed as the volume of the discharge region becomes gradually smaller, and then when a discharge valve (not shown) is opened at a set pressure or more, the refrigerant is discharged out of the hermetically sealed container 110 through the discharge opening 133*a* of the first cover 133, the discharge guide path 152 of the first bearing 150, and the discharge pipe 115 of the hermetically sealed container 110.

Further, as the first and second rotary members 130 and 140 are rotated, oil is supplied to a portion that is in sliding contact between the bearings 150 and 160 and the first and second rotary members 130 and 140 or between the first rotary member 130 and the second rotary member 140, thereby achieving lubrication between the members. Of course, the rotary shaft 141 is dipped in the oil stored in a lower part of the hermetically sealed container 110, and various types of oil supply paths for supplying oil are provided at the second rotary member 140. More specifically, when the rotary shaft 141 rotates, being dipped in the oil stored in the lower part of the hermetically sealed container 110, the oil rises along a spiral member 145 or a groove provided on the inside of the oil supply unit 141*b* of the rotary shaft 141, is discharged through an oil supply hole 141*c* of the rotary shaft 141, and is collected in an oil storage groove 141*d* between the rotary shaft 141 and the second bearing 160 and lubricate among the rotary shaft 141, the roller 142, the second bearing 160, and the second cover 134. In addition, the oil, collected in the oil storage groove 141*d* between the rotary shaft 141 and the second bearing 160, rises through the oil supply hole 142*b* of the roller 142, is collected in oil storage grooves 141*e* and 142*c* among the rotary shaft 141, the roller 142, and the first bearing 150, and lubricates among the rotary shaft 141, the roller 142, the first bearing 150, and the first cover 133. Besides, the oil may be configured to be supplied through oil grooves or oil holes between the vane 143 and the bushes 144, the configuration of this type will be omitted but the bushes 144 themselves may be made of self-lubricating members.

As seen from above, the refrigerant is sucked through the suction path 141*a* of the rotary shaft 141 and the oil is pumped through the oil supply unit 141*b* of the rotary shaft 141. Therefore, by defining a refrigerant circulating path and an oil circulating path on the rotary shaft 141, it is possible to prevent the refrigerant and the oil from being mixed with each other and to avoid a large amount of the oil from being discharged along with the refrigerant, thereby ensuring operation reliability.

Figure 13:
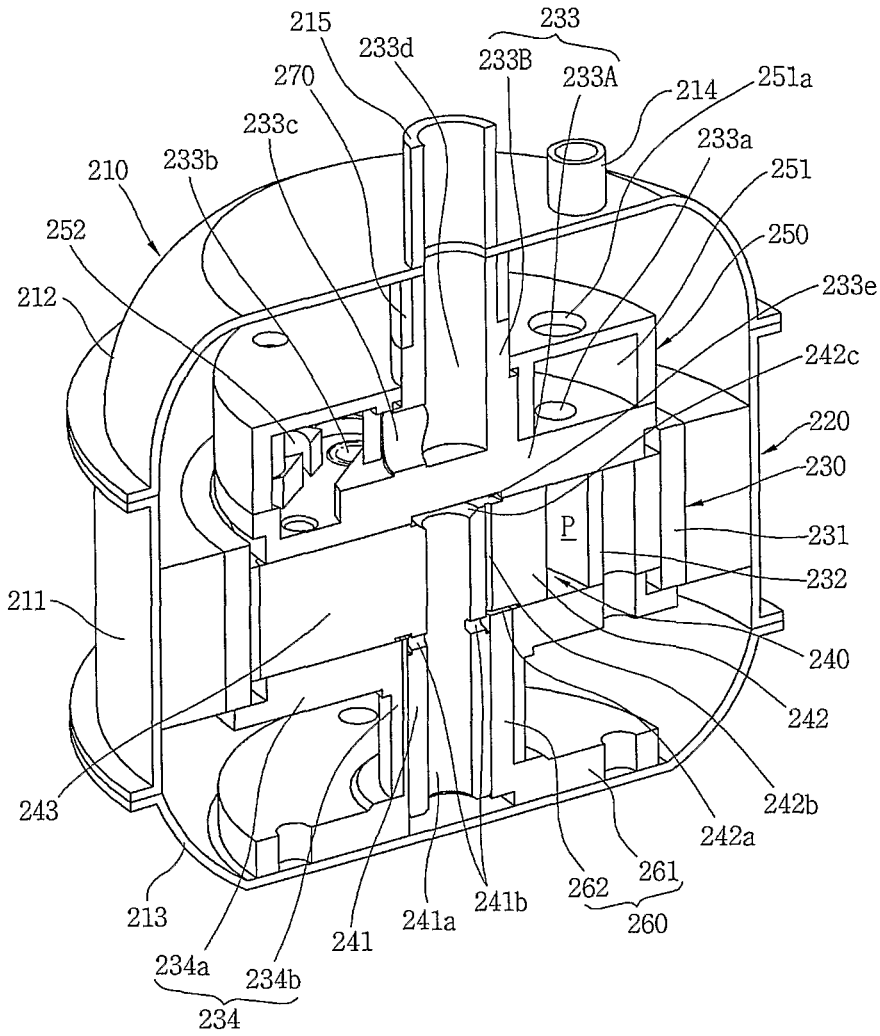
FIG. 13 is a side cross sectional view showing a second embodiment of the compressor according to the present invention.

FIG. 13 is a side cross sectional view showing a second embodiment of the compressor according to the present invention.

As shown in FIG. 13, the second embodiment of the compressor according to the present invention comprises a hermetically sealed container 210, a stator 220 installed inside the hermetically sealed container 210, a first rotary member 230 rotatably installed inside the stator 220 by interaction with the stator 220, a second rotary member 240 for compressing a refrigerant between the first and second rotary members 230 and 240 while rotating inside the first rotary member 230 upon receipt of a rotational force from the first rotary member 230, a muffler 250 for guiding the suction/discharge of the refrigerant to the compression space P between the first and second rotary members 230 and 240, and a bearing 260 for rotatably supporting the first rotary member 230 and the second rotary member 240 inside the hermetically sealed container 210 and a mechanical seal 270. In the second embodiment as well, like in the first embodiment, an electric motor part employs a kind of BLDG motor including the stator 220 and the first rotary member 230, and a compression mechanism part includes the first rotary member 230, the second rotary member 240, the muffler 250, the bearing 260, and the mechanical seal 270. Therefore, the overall height of the compressor can be decreased by widening the inner diameter of the electric motor part, rather than reducing the height of the electric motor part, and providing the compression mechanism part inside the electric motor part.

The hermetically sealed container 210 comprises a cylindrical body portion 211 and upper/lower shells 212 and 213 coupled to upper and lower parts of the body portion 211, and stores oil for lubricating the first and second rotary members 23) and 240 (shown in FIG. 1) up to an appropriate height. A suction pipe 214 for sucking a refrigerant is provided at one side of the upper shell 213, and a discharge pipe 215 for discharging the refrigerant is provided at the center of the upper shell 213. The type of the compressor is determined as a high pressure type or a low pressure type according to a connection structure of the suction pipe 214 and the discharge pipe 215. In the second embodiment of the present invention, the compressor is configured as the low pressure type. To this end, the suction pipe 214 is connected to the hermetically sealed container 210, and at the same time the discharge pipe 215 is directly connected to the compression mechanism part. Thus, when a low pressure refrigerant is sucked through the suction pipe 214, the refrigerant is introduced into the compression mechanism part, being filled inside the hermetically sealed container 210, and the high pressure refrigerant compressed in the compression mechanism part is discharged out directly through the discharge pipe 215.

The stator 220 includes a core and a coil concentratedly wound around the core. Since the stator 220 is configured in the same manner as in the stator of the first embodiment, a detailed description will be omitted.

The first rotary member 230 includes a rotor unit 231, a cylinder unit 232, a shaft cover 233, and a cover 234. The rotor unit 231 is formed in the shape of a cylinder which rotates within the stator 220 by a rotation magnetic field with the stator 220, and has a plurality of permanent magnets (not shown) inserted in an axial direction so as to generate a rotation magnetic field. Like the rotor unit 231, the cylinder unit 232 is also formed in the shape of a cylinder having a compression space P (shown in FIG. 1) formed therein. Like the first embodiment, the rotor unit 231 may be manufactured separately from the cylinder unit 232, and then matched in shape or integrally manufactured with the cylinder unit 232.

The shaft cover 233 and the cover 234 are coupled to the rotor unit 231 or cylinder unit 232 in the axial direction, and the compression space P is formed among the cylinder 232, the shaft cover 233, and the cover 234. The shaft cover 233 includes a flat plate-shaped cover portion 233A for covering the top surface of the roller 242 and a hollow shaft portion 233B projecting upwards at the center thereof. At the cover portion 233A of the shaft cover 233, a suction opening 233*a* for sucking a refrigerant into the compression space, a discharge opening 233*b* for discharging the refrigerant compressed in the compression space P, and a discharge valve (not shown) mounted on the discharge opening 233*b*. The shaft portion 233B of the shaft cover 233 is provided with discharge guide paths 233*c* and 233*d* for guiding the discharged refrigerant to outside of the hermetically sealed container 210 through the discharge opening 233*b*, and part of the outer peripheral surface of the tip end is stepped to be inserted into the mechanical seal 270. Similarly to the shaft cover 233, the cover 234 as well includes a flat plate-shaped cover portion 234*a* for covering the bottom surface of the roller 242 and a hollow shaft portion 234*b* projecting downwards at the center thereof. Though the shaft portion 234*b* may be omitted, the provision of the shaft portion 234*b* applying a load causes an increase in contact surface with the second bearing 260, thereby rotatably supporting the cover 234 more stably. Hereupon, the shaft cover 233 and the cover 234 are bolted to the rotor unit 231 or cylinder unit 232 in the axial direction, and hence the rotor unit 231, the cylinder unit 232, and the shaft cover and cover 233 and 234 rotate integrally with each other. Further, the muffler 250, too, is coupled in the axial direction of the shaft cover 233, and the muffler 250 includes a suction chamber 251 communicating with the suction opening 233*a* of the shaft cover 233 and a discharge chamber 252 communicating with the discharge opening 233*b* and discharge guide paths 233*c* and 233*d* of the shaft cover 233, the suction chamber 251 and the discharge chamber 252 being partitioned off from each other. Of course, the suction chamber 251 of the muffler 250 may be omitted, there are provided with the suction chamber 251 of the muffler 250 so as to suck the refrigerant in the hermetically sealed container 210 into the suction opening 233*a* of the shaft cover 233 and a suction opening 251*a* formed on the suction chamber 251.

The second rotary member 240 includes a rotary shaft 241, a roller 242, and a vane 243. The rotary shaft 241 projects from one axial surface, i.e., the bottom surface, of the roller 242. Since the rotary shaft 241 of the second embodiment projects only from the bottom surface of the roller 242, it is preferred that the projecting length of the rotary shaft 241 of the second embodiment from the bottom surface of the roller 242 is greater than the projecting length of the rotary shaft 141 (shown in FIG. 1) of the first embodiment from the bottom surface of the roller 142 (shown in FIG. 1) to rotatably support the second rotary member more stably. Even if the rotary shaft 241 and the roller 242 are separately formed, they should be configured to rotate integrally. The rotary shaft 241 is formed in a hollow shaft shape to penetrate the inside of the roller 242, and the hollow portion is comprised of an oil supply unit 241*a* for pumping oil. On the oil supply unit 241*a* of the rotary shaft 241, a spiral member for helping the oil rise by a rotational force may be mounted, or grooves for helping the oil rise by a capillary tube phenomenon may be formed. On the rotary shaft 241 and the roller 242, there are provided various types of oil supply holes 241*b* and 242*b* for supplying the oil supplied through the oil supply unit 241*a* between two or more members where a sliding action occurs and oil storage grooves 242*a* and 242*c* are provided. Like the first embodiment, the vane 243 is provided extending in a radial direction on the outer peripheral surface of the roller 242. The mounting structure of the vane 243 and the operation cycle of the compression mechanism part in the first embodiment are identical to the mounting structure of the vane 143 and the operation cycle of the compression mechanism part in the second embodiment, and thus a detailed description thereof will be omitted.

The first and second rotary members 230 and 240 of these types are rotatably supported on the inside of the hermetically sealed container 210 by the bearing 260 and mechanical seal 270 coupled in the axial direction. The bearing 260 is bolted to the lower shell 213, and the mechanical seal 270 is fixed to the inside of the hermetically sealed container 210 by welding or the like so as to communicate with the discharge pipe 215 of the hermetically sealed container 211.

The mechanical seal 270 is a device which prevents leakage of fluids by contact between a stationary portion and a rotating portion on a shaft rotating at a high speed, and is installed between the discharge pipe 215 of the hermetically sealed container 210, which is stationary, and the shaft portion 233B of the shaft cover 233, which is rotating. At this time, the mechanical seal 270 supports the shaft cover 233 so as to be rotatable inside the hermetically sealed container 210, and communicates the shaft portion 233B of the shaft cover 233 and the discharge pipe 215 of the hermetically sealed container 210 and seals to prevent leakage of the refrigerant between them.

The bearing 260 includes a journal bearing for rotatably supporting the outer peripheral surface of the rotary shaft 241 and the inner peripheral surface of the cover 234 and a thrust bearing for rotatably supporting the bottom surface of the roller 242 and the bottom surface of the second cover 134. The second bearing 260 includes a flat plate-shaped support portion 261 bolted to the lower shell 213 and a shaft portion 262 provided with a hollow portion 262*a* (shown in FIG. 17 to be described below) projecting upwards at the center of the support portion 261. At this time, the center of the hollow portion 262*a* of the second bearing 260 is located eccentrically from the center of the shaft portion 262 of the bearing 260. Depending on the eccentricity of the roller 242, the center of the hollow portion 262*a* of the bearing 260 coincides with the center of the shaft portion 262 of the bearing 260. This will be described in detail below.

Figure 14:
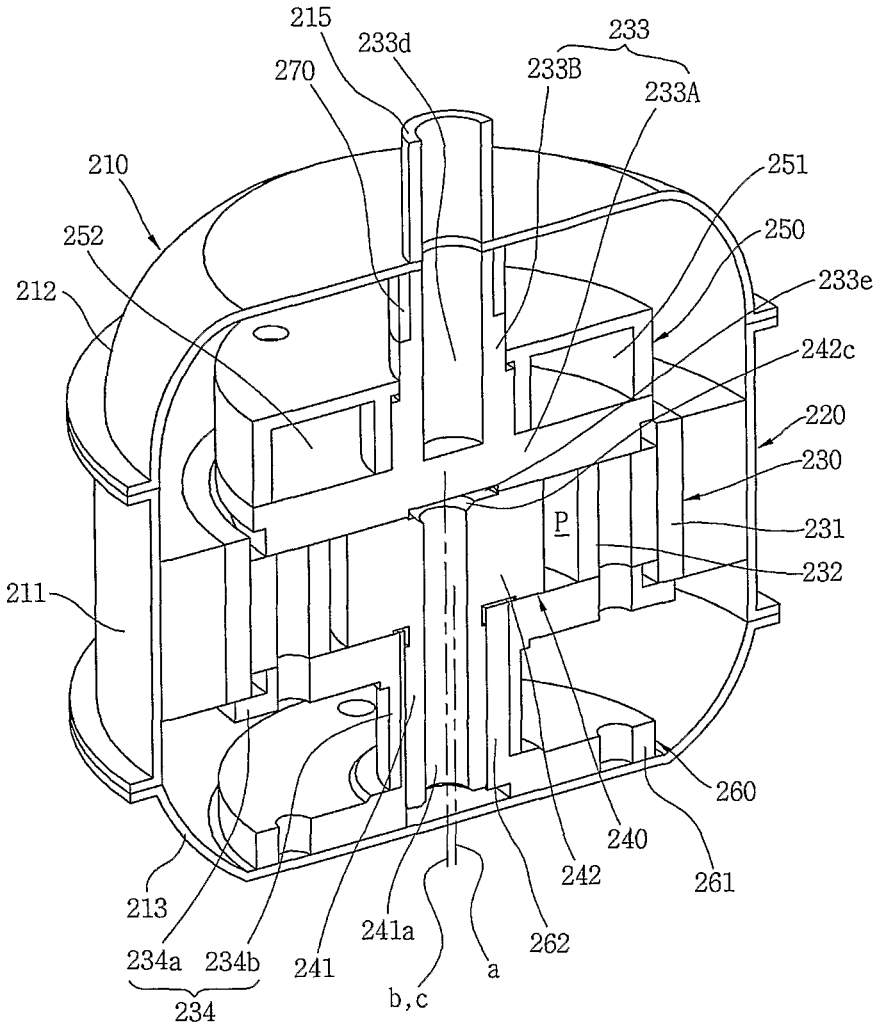
FIGS. 14 to 16 are side cross sectional views showing a rotational center line of the second embodiment of the compressor according to the present invention.
Figure 15:
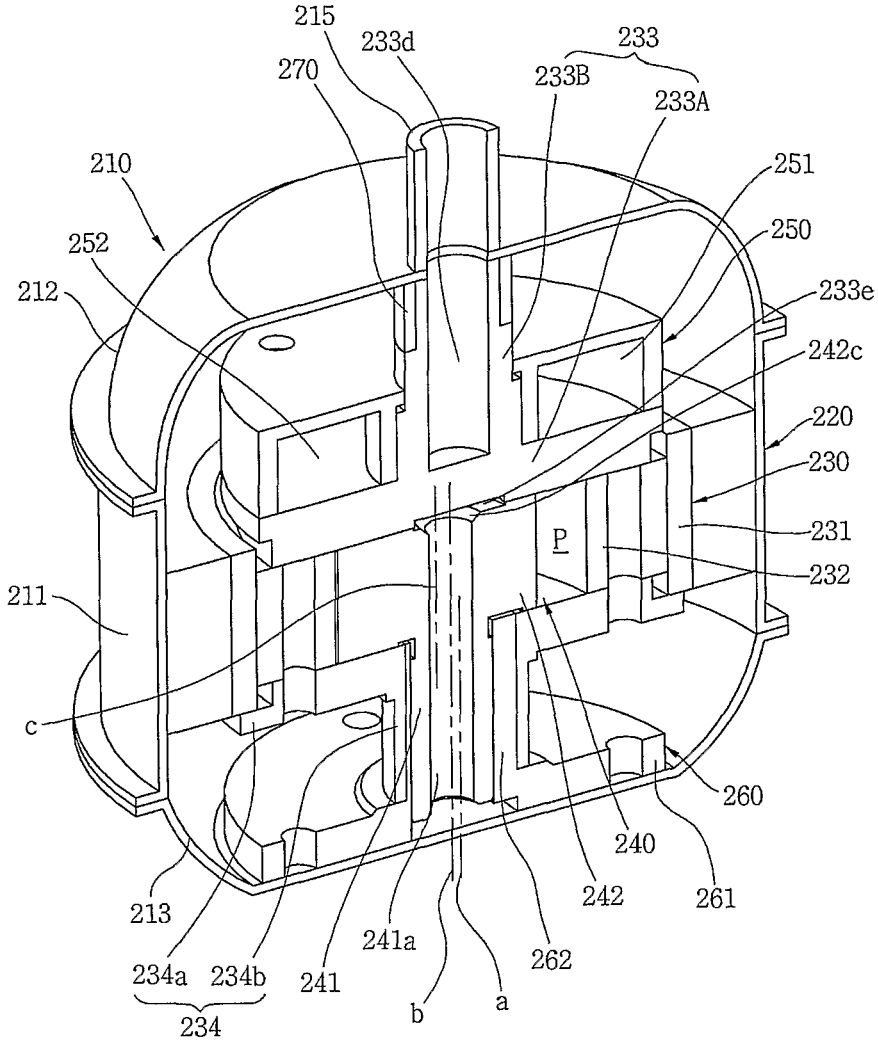
Figure 16:
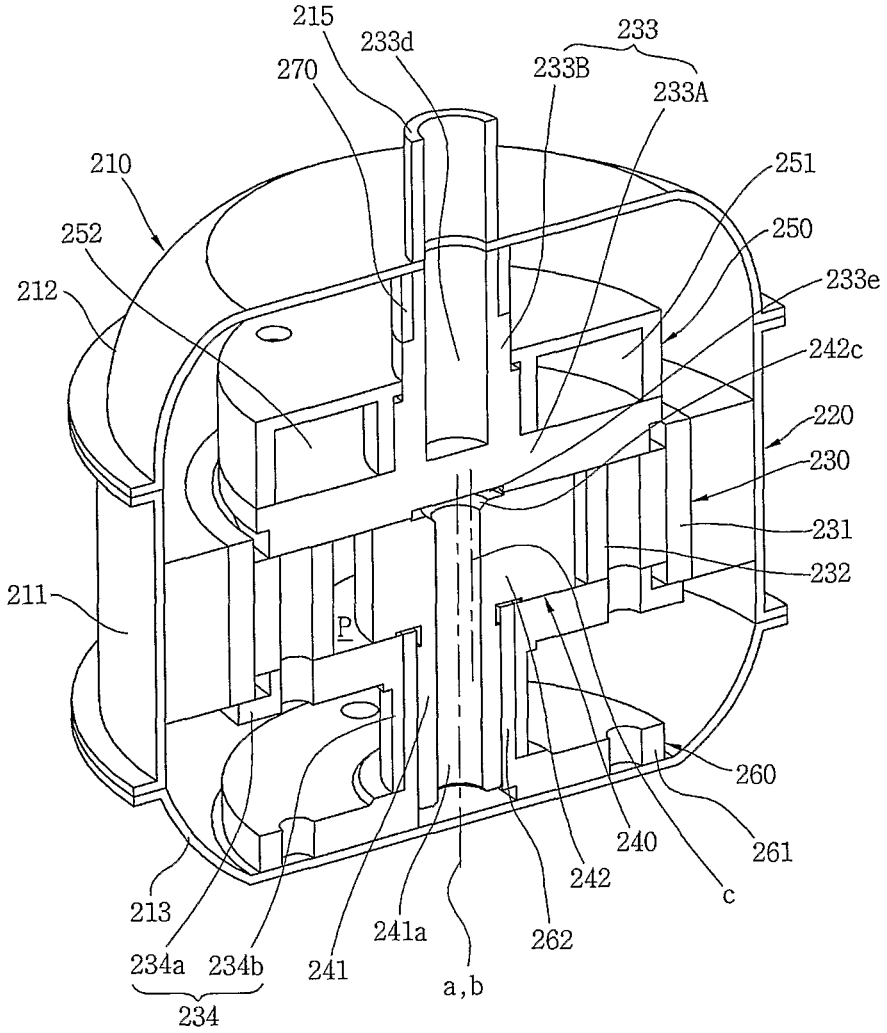

FIGS. 14 to 16 are side cross sectional views showing a rotational center line of the second embodiment of the compressor according to the present invention.

The second rotary member 240 is located eccentrically with respect to the first rotary member 230 so as to compress the refrigerant while the first and second rotary members 230 and 240 simultaneously rotate. The relative locations of the first and second rotary members 230 and 240 will be described with reference to FIGS. 14 to 16. Hereupon, a denotes the center line of a first rotary shaft of the first rotary member 230, and may also be regarded as the longitudinal center line of the shaft portion 234*b* of the second cover 234 and the longitudinal center line of the shaft portion 262 of the bearing 260. Like the first embodiment, since the first rotary member 230 includes the rotor unit 231, the cylinder unit 232, the shaft cover 233, and the cover 234 and they rotate integrally with each other, a may be regarded as their rotational center lines. b denotes the center line of a second rotary shaft of the second rotary member 240, and may also be regarded as the longitudinal center line of the rotary shaft 241. c denotes the longitudinal center line of the second rotary member 240, and may also be regarded as the longitudinal center line of the roller 242.

As shown in FIG. 14, the center line b of the second rotary shaft is spaced a predetermined gap apart from the center line a of the first rotary shaft, and the longitudinal center line c of the second rotary member 240 coincides with the center line b of the second rotary shaft. Accordingly, the second rotary member 240 is configured to be eccentric with respect to the first rotary member 230, and when the first and second rotary members 230 and 240 rotate together by the medium of the vane 243, the second rotary member 240 and the first rotary member 230 are brought into contact with or spaced apart from each other in a repetitive manner as in the first embodiment, thus compressing the refrigerant within the compression space.

As shown in FIG. 15, the center line b of the second rotary shaft is spaced a predetermined gap apart from the center line a of the first rotary shaft, and the longitudinal center line c of the second rotary member 240 is spaced a predetermined gap apart from the center line b of the second rotary shaft, and the center line a of the first rotary shaft and the longitudinal center line c of the second rotary member 240 do not coincide with each other. Similarly, the second rotary member 240 is configured to be eccentric with respect to the first rotary member 230, and when the first and second rotary members 230 and 240 rotate together by the medium of the vane 243, the second rotary member 240 and the first rotary member 230 are brought into contact with or spaced apart from each other in a repetitive manner as in the first embodiment, thus compressing the refrigerant within the compression space.

As shown in FIG. 16, the center line b of the second rotary shaft coincides with the center line a of the first rotary shaft, and the longitudinal center line of the second rotary member 240 is spaced a predetermined gap apart from the center line a of the first rotary shaft and the center line b of the second rotary shaft. Similarly, the second rotary member 240 is configured to be eccentric with respect to the first rotary member 230, and when the first and second rotary members 230 and 240 rotate together by the medium of the vane 243, the second rotary member 240 and the first rotary member 230 are brought into contact with or spaced apart from each other in a repetitive manner as in the first embodiment, thus compressing the refrigerant within the compression space.

Figure 17:
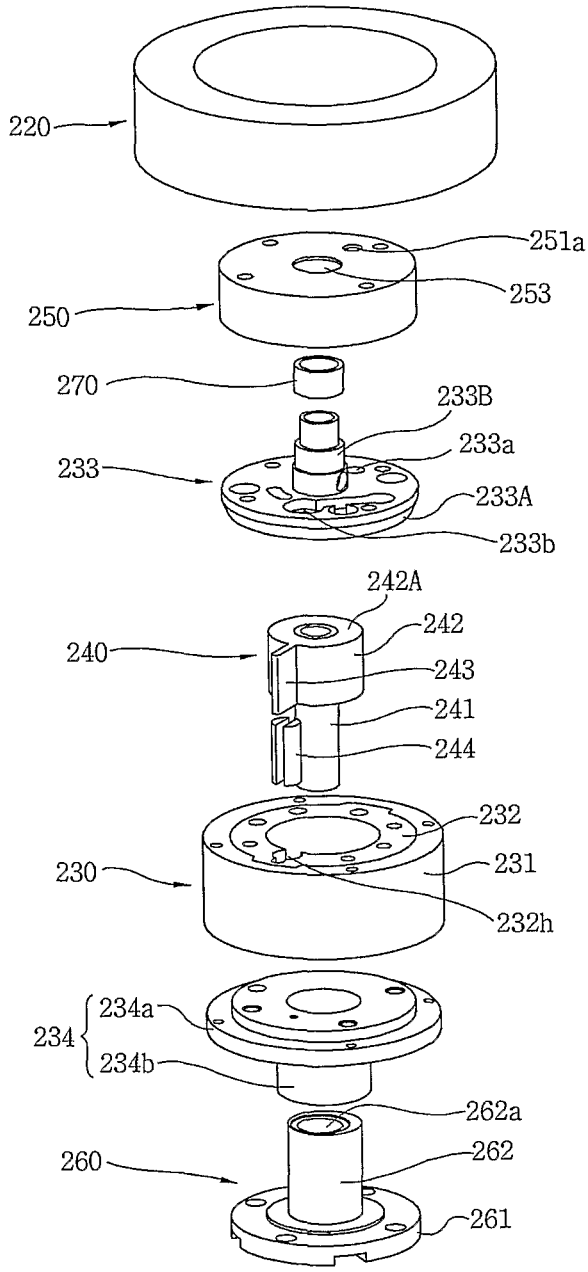
FIG. 17 is an exploded perspective view showing the second embodiment of the compressor according to the present invention.

FIG. 17 is an exploded perspective view showing the second embodiment of the compressor according to the present invention.

Describing one example of coupling in the second embodiment of the compressor according to the present invention with reference to FIGS. 13 and 17, the rotor unit 231 and the cylinder unit 232 may be separately manufactured and coupled to each other, or may be integrally manufactured. Preferably, the rotary shaft 241, the roller 242, and the vane 243 are integrally manufactured. Alternatively, they may be separately manufactured, but they are coupled to each other so as to integrally rotate. The vane 243 is fitted to the inside of the cylinder unit 231 by bushes 244, and the rotary shaft 241, the roller 242, and the vane 243 are mounted entirely on the inside of the rotor unit 231 and cylinder unit 232. The shaft cover 233 and the cover 234 are bolt-coupled in the axial direction of the rotor unit 231 and cylinder unit 232. While the shaft cover 233 is installed so as to cover the roller 242, the cover 234 is installed so as to cover the roller 242 in a state that the rotary shaft 241 is penetrated. Further, the muffler 250 is bolted in the axial direction of the shaft cover 233, and the shaft portion 233B of the shaft cover 233 is fitted to a shaft cover mounting device 253 of the muffler 250 and penetrates the muffler 250. Of course, in order to prevent leakage of the refrigerant between the shaft cover 233 and the muffler 250, it is preferred to add a separate sealing member (not shown) to a coupling portion of the shaft cover 233 and the muffler 250.

In this manner, when a rotation assembly having the first and second rotary members 230 and 240 assembled therein is assembled, the bearing 260 is bolted to the lower shell 213, and then the rotation assembly is assembled to the bearing 260. The inner peripheral surface of the shaft portion 234*a* of the cover 234 comes in contact with the outer peripheral surface of the shaft portion 262 of the bearing 260, and the outer peripheral surface of the rotary shaft 241 is comes in contact with the hollow portion 262*a* of the second bearing 260. Afterwards, the stator 220 is press-fitted into the body portion 211, and the body portion 211 is coupled to the lower shell 212, and the stator 220 is located so as to maintain a gap on the outer peripheral surface of the rotation assembly. Thereafter, the mechanical seal 270 is coupled to the inside of the upper shell 212 so as to communicate with the discharge pipe 215, and the upper shell 212 with the mechanical seal 270 fixed thereto is coupled to the body portion 211 such that the mechanical seal 270 is inserted into a stepped part on the outer peripheral surface of the shaft portion 233B of the shaft cover 233. Of course, the mechanical seal 270 couples the shaft portion 233B of the shaft cover 233 and the discharge pipe 215 of the upper shell 212 so as to make them communicate with each other.

Therefore, the rotation assembly having the first and second rotary members 230 and 240 assembled therein, the body portion 211 having the stator 220 mounted thereon, the upper shell 212 having the mechanical seal 270 mounted thereon, and the lower shell 213 having the bearing 260 mounted thereon are coupled in the axial direction, the mechanical seal 270 and the bearing 260 are supported on the hermetically sealed container 210 so as to make the rotation assembly rotatable in the axial direction.

Figure 18:
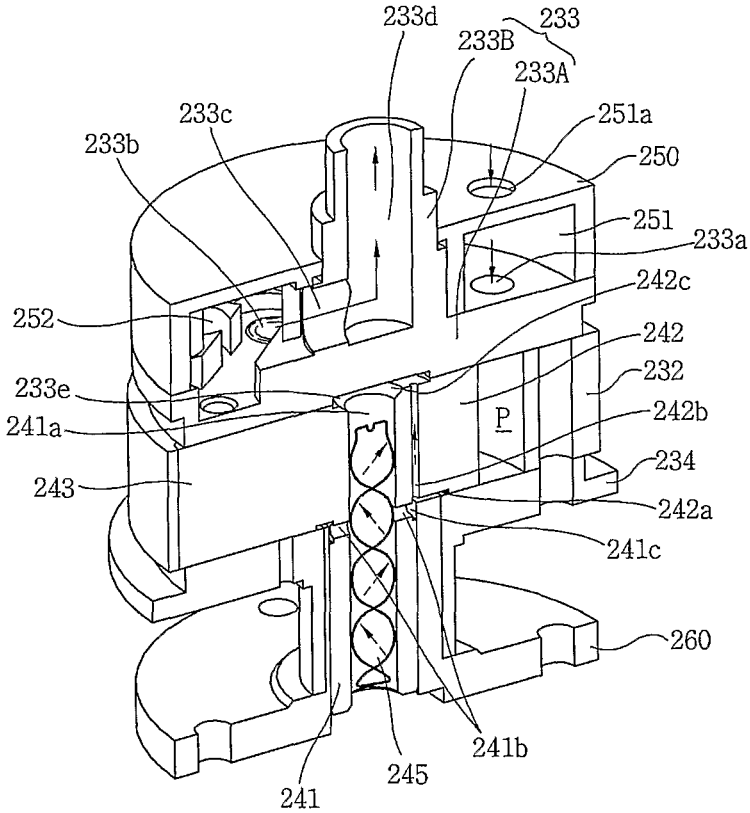
FIG. 18 is a side cross sectional view showing the movement of refrigerant and the flow of oil in the second embodiment of the compressor according to the present invention.

FIG. 18 is a side cross sectional view showing the movement of refrigerant and the flow of oil in the second embodiment of the compressor according to the present invention.

The operation of the second embodiment of the compressor according to the present invention will be described with reference to FIGS. 13 and 18. As current is supplied to the stator 220, a rotation magnetic field is generated between the stator 220 and the rotor unit 231. Then, by a rotational force of the rotor unit 231, the first rotary member 230, i.e., the rotor unit 231, cylinder unit 232, shaft cover 233, and cover 234 integrally rotate. Hereupon, since the vane 234 is installed on the cylinder unit 231 so as to be reciprocatable, the rotational force of the first rotary member 230 is transmitted to the second rotary member 240, and the second rotary member 240, i.e., the rotary shaft 241, roller 242, and vane 243 integrally rotate. Hereupon, as shown in FIGS. 14 to 16, the first and second rotary members 230 and 240 are located eccentrically with respect to each other. Thus, as the cylinder unit 232 and the roller 242 are brought into contact with and spaced apart from each other in a repetitive manner, the volumes of the suction region and the discharge region which are divided by the vane 243 are varied to thus compress the refrigerant, and at the same time oil is pumped to thus lubricate between the two members in sliding contact.

When the first and second rotary members 230 and 240 are rotated by the medium of the vane 243, the refrigerant is sucked, compressed, and discharged. More specifically, as the roller 242 and the cylinder unit 232 are brought into contact with and spaced apart from each other in a repetitive manner while they are rotating with each other, the volumes of the suction region S and discharge region D partitioned by the vane 243 are varied to thus suck, compress, and discharge the refrigerant. In other words, as the volume of the suction region becomes gradually larger by quantum rotation, the refrigerant is sucked into the suction region of the compression space P through the suction pipe 214 of the hermetically sealed container 210, the inside of the hermetically sealed container 210, the suction opening 251*a* and action chamber 251 of the muffler 250, and the suction opening 233*a* of the shaft cover 233*a*. At the same time, the refrigerant is compressed as the volume of the discharge region becomes gradually smaller by quantum rotation, and then when a discharge valve (not shown) is opened at a set pressure or more, the refrigerant is discharged out of the hermetically sealed container 210 through the discharge opening 233*b* of the first cover 233, the discharge chamber 252 of the muffler 250, the discharge paths 233*c* and 233*d* of the shaft cover 233, and the discharge pipe 215 of the hermetically sealed container 210. Of course, as a high pressure refrigerant passes through the discharge chamber 252 of the muffler 250, noise is reduced.

Further, as the first and second rotary members 230 and 240 are rotated, oil is supplied to the portions that are in sliding contact between the bearing 260 and the first and second rotary members 230 and 240, thereby achieving lubrication between the members. Of course, the rotary shaft 241 is dipped in the oil stored in a lower part of the hermetically sealed container 210, and various types of oil supply paths for supplying oil are provided at the second rotary member 240. More specifically, when the rotary shaft 241 rotates, being dipped in the oil stored in the lower part of the hermetically sealed container 210, the oil rises along a spiral member 245 or a groove (단수?복수?) provided on the inside of the oil supply unit 241*a* of the rotary shaft 241, is discharged through an oil supply hole 241*b* of the rotary shaft 241, and is collected in an oil storage groove 241*c* between the rotary shaft 241 and the bearing 260 and lubricate among the rotary shaft 241, the roller 242, the bearing 260, and the cover 234. In addition, the oil, collected in the oil storage groove 241*c* between the rotary shaft 241 and the bearing 260, rises through the oil supply hole 242*b* of the roller 242, is collected in oil storage grooves 233*e* and 242*c* among the rotary shaft 241, the roller 242, and the shaft cover 233, and lubricates among the rotary shaft 241, the roller 242, and the shaft cover 233. In the second embodiment, the roller 242 may not require the oil supply hole 242*b*. This is because the oil supply unit 242*a* extends up to a height at which the roller 242 and the shaft cover 233 are in contact so that oil can be supplied directly to the oil storage grooves 233*e* and 242*c* through the oil supply unit 242*a*. Besides, while the oil may be configured to be supplied through oil grooves or oil holes between the vane 243 and the bushes 244, the bushes 244 themselves may be made of self-lubricating members as clearly described in the first embodiment.

As seen from above, the refrigerant is sucked/discharged through the shaft cover 233 and the muffler 250, and the oil is supplied among the members through the rotary shaft 241 and the roller 242. Therefore, by defining a refrigerant circulating path and an oil circulating path as separate members, it is possible to prevent the refrigerant and the oil from being mixed with each other and to avoid a large amount of the oil from being discharged along with the refrigerant, thereby ensuring operation reliability.

The present invention has been described in detail with reference to the embodiments and the attached drawings. However, the scope of the present invention is not limited to these embodiments and drawings, but defined by the appended claims.

The invention claimed is:

1. A compressor, comprising:

a stator that generates an electromagnetic field inside the stator;

a first rotary member that rotates, within the stator, around a first rotary shaft that longitudinally extends concentrically with respect to a center of the stator, due to the electromagnetic field from the stator;

a second rotary member that compresses a refrigerant in a compression space formed between the first and second rotary members while rotating, within the first rotary member, around a second rotary shaft upon receipt of a rotational force from the first rotary member; and a vane for that transmits the rotational force to the second rotary member from the first rotary member, and partitions the compression space into a suction region into which the refrigerant is sucked and a compression region in which the refrigerant is compressed and then discharged, wherein the first rotary member includes a cylindrical rotor that rotates within the stator and includes a plurality of permanent magnets inserted therein in an axial direction of the first rotary member and a cylinder inside the rotor that forms the compression space with the secondary rotary member, and wherein the rotor and the cylinder comprise a plurality of corresponding mounting projections and grooves on an outer peripheral surface of the cylinder and an inner peripheral surface of the rotor, respectively, such that the rotor and the cylinder are separately manufactured and coupled by matching the plurality of corresponding mounting projections and grooves on the outer peripheral surface of the cylinder and the inner peripheral surface of the rotor, respectively.

2. The compressor of claim 1, wherein a center line of the second rotary shaft is spaced apart from a center line of the first rotary shaft.

3. The compressor of claim 2, wherein a longitudinal center line of the second rotary member coincides with a center line of the second rotary shaft.

4. The compressor of claim 2, wherein a longitudinal center line of the second rotary member is spaced apart from a center line of the second rotary shaft.

5. The compressor of claim 1, wherein a center line of the second rotary shaft coincides with a center line of the first rotary shaft, and wherein a longitudinal center line of the second rotary member is spaced apart from center lines of the first rotary shaft and the second rotary shaft.

6. The compressor of claim 1, wherein the vane is integrally formed with the second rotary member, and wherein the first rotary member comprises:

a vane mounting device; and a plurality of bushes provided in the vane mounting device, that guides a reciprocating motion of the vane within the vane mounting device of the first rotary member along with the rotation of the first rotary member and the second rotary member.

7. The compressor of claim 1, wherein the vane is integrally formed with the first rotary member, and wherein the second rotary member comprises:

a vane mounting device; and a plurality of bushes provided in the vane mounting device, that guides a reciprocating motion of the vane within the vane mounting device of the second rotary member along with the rotation of the first rotary member and the second rotary member.

8. The compressor of claim 6, wherein the vane mounting device penetrates in a longitudinal direction so as to communicate with the inner peripheral surface of the cylinder, and wherein the plurality of bushes is provided in one pair so as to be in contact with both sides of the vane.

9. The compressor of claim 6, wherein the vane extends in a radial direction of the second rotary member so as to face a center of the second rotary shaft, and wherein the plurality of bushes and a bush mounting device guide the vane to reciprocate in the radial direction of the second rotary member.

10. The compressor of claim 7, wherein the vane extends in a radial direction of the first rotary member so as to face a center of the first rotary shaft, and wherein the plurality of bushes and a bush mounting device guide the vane to reciprocate in the radial direction of the first rotary member.

11. The compressor of claim 1, wherein the vane is hingeably coupled to the second rotary member and inserted into a groove formed on the first rotary member, and wherein the vane reciprocates within the groove according to the rotation of the first rotary member and the second rotary member.

12. The compressor of claim 1, wherein the vane is hingeably coupled to the first rotary member and inserted into a groove formed on the second rotary member, and wherein the vane reciprocates within the groove according to the rotation of the first rotary member and the second rotary member.

13. The compressor of claim 1, wherein first and second covers are further provided which are located in the axial direction of first rotary member and an axial direction of the second rotary member, and form the compression space between the first rotary member and the second rotary member while integrally rotating with one of the first and second rotary members.

14. The compressor of claim 13, wherein the compressor is provided inside a hermetically sealed container, and wherein at least one bearing member is further provided which is fixed to the inside of the hermetically sealed container, to rotatably support the first and second rotary members including the first and second covers.

15. The compressor of claim 1, wherein the first rotary member further comprises a first cover and a second cover coupled to upper and lower portions of the first rotary member, respectively, and that integrally rotate with the first rotary member so as to form the compression space between the first and second rotary members, and wherein the second rotary member comprises a roller that forms the compression space together with the first rotary member and the second rotary shaft that rotates integrally with the roller and extends to one or more of the first and second covers.

16. The compressor of claim 15, wherein the compressor further comprises at least one bearing member provided inside a hermetically sealed container, to rotatably support the first and second cover and the second rotary shaft, and wherein the at least one bearing is fixed to the inside of the hermetically sealed container.

17. The compressor of claim 1, further comprising a suction path formed to penetrate a portion of the second rotary shaft and a portion of the second rotary member.

18. The compressor of claim 1, further comprising a discharge path formed to penetrate a portion of the first rotary shaft.

19. The compressor of claim 1, further comprising:

a refrigerant suction path and a refrigerant discharge path that penetrate the first rotary shaft and the second rotary shaft, respectively; and an oil supply path isolated from the refrigerant suction path and the refrigerant discharge path.

20. The compressor of claim 6, further comprising:

a first cover and a second cover located at upper and lower portions of the first rotary member and the second rotary member, respectively, and that form the compression space between the first and second rotary members while rotating integrally with the first rotary member; and a plurality of fixing fasteners that fixes the plurality of bushes to one or more of the first and second covers.

21. The compressor of claim 7, further comprising:

a first cover and a second cover located at upper and lower portions of the first rotary member and the second rotary member, and that form the compression space between the first and second rotary members while rotating integrally with the first rotary member; and a plurality of fixing fasteners that fixes the vane to one or more of the first and second covers.

22. The compressor of claim 21, wherein each of the plurality of fixing fasteners is a pin which is inserted so as to penetrate corresponding fastening grooves formed on the first and second covers and a tip end portion of the vane.

* * * * *